US006095703A

United States Patent [19]

Tanaka et al.

[11] Patent Number: 6,095,703

[45] Date of Patent: Aug. 1, 2000

[54] IMAGE RECORDING APPARATUS UTILIZING SERIAL RECORDING HEAD AND SHEET FEED AND IMAGE RECORDING METHOD THEREFOR

[75] Inventors: Sohei Tanaka; Akio Takeda, both of Kawasaki; Yasuhiro Numata, Yokohama, all of Japan

[73] Assignee: Canon Kabushiki Kaisha, Tokyo, Japan

[21] Appl. No.: 08/961,991

[22] Filed: Oct. 31, 1997

Related U.S. Application Data

[63] Continuation of application No. 08/309,623, Sep. 21, 1994, abandoned, which is a continuation of application No. 07/766,330, Sep. 26, 1991, abandoned.

[30] Foreign Application Priority Data

| | | | |
|---|---|---|---|
| Sep. 27, 1990 | [JP] | Japan | 2-255047 |
| Oct. 12, 1990 | [JP] | Japan | 2-272394 |
| Nov. 27, 1990 | [JP] | Japan | 2-321016 |

[51] Int. Cl.[7] ..... B41J 11/42

[52] U.S. Cl. ..... 400/582; 400/636; 400/618; 400/706; 395/111

[58] Field of Search ..... 400/550, 555, 400/568, 583, 583.4, 618, 636, 706, 707.1, 708, 708.1, 902, 124.04, 636.1; 347/101, 104, 218, 219; 395/111

[56] References Cited

U.S. PATENT DOCUMENTS

| | | | |
|---|---|---|---|
| 3,732,480 | 5/1973 | Hendrickson et al. | 400/902 |
| 4,034,842 | 7/1977 | Giacone | 400/902 |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,688,050 | 8/1987 | Tsao | 400/706 |
| 4,723,129 | 2/1988 | Endo et al. . | |
| 4,740,796 | 4/1988 | Endo et al. . | |
| 4,834,277 | 5/1989 | Gomoll et al. | 400/618 |
| 4,834,564 | 5/1989 | Oda | 400/568 |
| 4,858,908 | 8/1989 | Yamada | 271/265 |
| 4,898,488 | 2/1990 | Yokoi et al. | 400/605 |
| 4,913,574 | 4/1990 | Yokoi | 400/636.2 |
| 4,941,021 | 7/1990 | Uchida et al. | 271/265 |
| 4,975,780 | 12/1990 | Kuboki . | |
| 5,128,858 | 7/1992 | Kitabata | 400/550 |
| 5,131,770 | 7/1992 | Kanemitsu | 400/568 |
| 5,602,571 | 2/1997 | Suda et al. | 400/618 |

FOREIGN PATENT DOCUMENTS

| | | | |
|---|---|---|---|
| 0369467 | 5/1990 | European Pat. Off. . | |
| 3316668 | 11/1983 | Germany . | |
| 59-123670 | 7/1984 | Japan . | |
| 59-138461 | 8/1984 | Japan . | |
| 99680 | 6/1985 | Japan | 400/582 |
| 151079 | 8/1985 | Japan | 400/706 |
| 58784 | 3/1986 | Japan | 400/706 |
| 61-118276 | 6/1986 | Japan . | |
| 87376 | 4/1987 | Japan | 400/555 |
| 117756 | 5/1987 | Japan | 400/568 |
| 169662 | 7/1987 | Japan | 400/555 |
| 187071 | 8/1987 | Japan | 400/706 |
| 132076 | 6/1988 | Japan | 400/555 |
| 190478 | 7/1989 | Japan | 400/706 |
| 314183 | 12/1989 | Japan | 400/706 |
| 2249840 | 10/1990 | Japan . | |

*Primary Examiner*—Christopher A. Bennett
*Attorney, Agent, or Firm*—Fitzpatrick, Cella, Harper & Scinto

[57] ABSTRACT

An image recording apparatus, having a recording head and a pair of transport rollers in front of the recording head and another pair of transport rollers behind the recording head, with a larger transport speed for a recording sheet in the latter pair for applying a suitable tension on the recording sheet, is capable of detecting the remaining amount of the sheet in front of the first pair and varying the transport speed and/or the recording area of the recording head after the rear end of the sheet leaves the first paired roller. Consequently, a potential error in record position, resulting from sheet advancement by the second paired rollers only, can be compensated. In this manner the area of precise image recording on the sheet can be expanded.

54 Claims, 30 Drawing Sheets

| | | |

| SHEET SIZE | REMAINING AMOUNT AFTER 20mm CARRYING | NUMBER OF STEPS UNTIL SENSOR DETECTION | REMAINING AMOUNT AT THE TIME OF SENSOR DETECTION |
|---|---|---|---|
| B4 257 × 364 | 344mm | 42 TIMES | 8mm |
| A4 210 × 297 | 277mm | 34 TIMES | 5mm |
| B5 182 × 257 | 237mm | 29 TIMES | 5mm |
| A5 148 × 210 | 190mm | 23 TIMES | 6mm |
| B6 128 × 182 | 162mm | 19 TIMES | 10mm |
| A6 105 × 148 | 128mm | 15 TIMES | 8mm |

FIG. 42B

| SHEET SIZE | REMAINING AMOUNT AFTER 20mm CARRYING | NUMBER OF STEPS UNTIL SENSOR DETECTION | DISTANCE BETWEEN SHEET TRAILING DEGE AT THE TIME OF SENSOR DETECTION AND PRINTING TRAILING EDGE | NUMBER OF REMAINING STEPS AVAILABLE FOR 8mm PRINT | UNPRINTABLE AMOUNT FOR 8mm PRINT |
|---|---|---|---|---|---|
| B4 257 × 364 | 344mm | 42 TIMES | 18mm | 2 TIMES | 2mm |
| A4 210 × 297 | 277mm | 34 TIMES | 15mm | ONCE | 7mm |
| B5 182 × 257 | 237mm | 29 TIMES | 15mm | ONCE | 7mm |
| A5 148 × 210 | 190mm | 23 TIMES | 16mm | 2 TIMES | 0mm |
| B6 128 × 182 | 162mm | 19 TIMES | 20mm | 2 TIMES | 4mm |
| A6 105 × 148 | 128mm | 15 TIMES | 18mm | 2 TIMES | 2mm |
| | ① | ② | ①-②× 8 + 10 =③ | ④ | ③- 8 ×④ |

| PRINTABLE AMOUNT AT THE TIME OF SENSOR DETECTION | NUMBER OF REMAINING STEPS AVAILABLE FOR 8mm PRINT | UNPRINTABLE AMOUNT FOR 8mm PRINT |
|---|---|---|
| 13mm | ONCE | 5mm |
| 10mm | ONCE | 2mm |
| 10mm | ONCE | 2mm |
| 11mm | ONCE | 3mm |
| 15mm | ONCE | 7mm |
| 13mm | ONCE | 5mm |

③ - 5mm = ⑤

IMAGE RECORDING APPARATUS UTILIZING SERIAL RECORDING HEAD AND SHEET FEED AND IMAGE RECORDING METHOD THEREFOR

This application is a continuation of application Ser. No. 08/309,623 filed Sep. 21, 1994, now abandoned, which is a continuation of application Ser. No. 07/766,330 filed Sep. 26, 1991, abandoned.

BACKGROUND OF THE INVENTION

1. Field of the Invention

The present invention relates to an image recording apparatus utilizing serial recording, and more particularly to an image recording apparatus capable of effecting print control on the end portion of a recording medium such as paper or film, and an image recording method therefor.

2. Related Background Art

FIG. 1 illustrates a conventional image forming apparatus utilizing, for example, the ink jet recording system and adapted for use in a copying machine, a printer or the like.

During the recording operation of said apparatus, the recording medium (hereinafter also called recording sheet) is transported by transport rollers and discharge rollers, each positioned as a vertical pair. The amount of advancement of the recording sheet is equal to the pitch of rows, for example 8 mm. In order to apply a constant tension to the recording sheet, the amount of advancement by the discharge rollers is selected larger, for example by 1%, than that of the transport rollers. Therefore, in the course of recording operation, the recording sheet is advanced by 8 mm if the distance from the transport rollers to the rear end of the sheet is at least equal to 8 mm, as shown in FIG. 2(*a*).

In the following, the structure of the above-mentioned image forming apparatus will be explained with reference to FIG. 1.

In the bottom portion of a main body 1 of the apparatus, there is accommodated a cassette 3 containing a stack of plural sheets 2. To the left in said drawing, there is provided a carriage 5 supporting a recording head 4, and a platen 6 is provided under said recording head 4.

The recording head 4 is of an ink jet type for recording on the sheet member 2, and includes ink discharge openings 16 provided in a quantity m at the end of an ink discharge portion 15 as shown in FIG. 3. Internally there is provided an unshown ink chamber which serves to discharge ink droplets from the m discharge openings 16 according to image signals. The carriage 5 is linked with an unshown carriage driving motor through a timing belt, and performs reciprocating motion along a guide shaft 5*a* by said motor.

In order to combine the recording in different rows, the advancement of the sheet member 2 by the lower transport roller 7 has to be conducted with a high precision, in the order of 10 $\mu$m. For this purpose the lower transport roller 7 is finished with a precise diameter, and a stepping or pulse motor of a high stopping precision is employed as the driving device and controls the rotational angle of said roller 7 by the number of pulses.

In said apparatus, when a sheet feed roller 11 is rotated in response to a feed signal, an uppermost sheet 2 is separated from the stack and advanced between sheet guides 9, 10.

Being guided by said guides 9, 10, the sheet 2 advances to the nip between the lower transport roller 7, driven by the not shown drive motor, and an upper transport roller 8 which is driven by said lower transport roller 7.

Then the sheet 2 passes on the platen 6 by the transporting force of the lower roller 7 and the upper roller 8 to reach discharge (pulling) rollers 12, 13, and temporarily stops when the leading end is pinched between said rollers 12, 13.

The lower pulling roller 12 rotates in linkage with the lower transport roller 7 but has a somewhat larger peripheral speed, and the pinching force of the rollers 12, 13 on the sheet 2 is selected weaker than that of the transport rollers 7, 8, whereby the sheet 2 is maintained without slack under a suitable tension.

In this state the recording head 4 supported by the carriage 5 moves in a direction away from the viewer in FIG. 1 and discharges ink according to the image signals, thereby forming a recording of a predetermined width (recording width) on the sheet member 2. Said recording width W is represented by m×d, wherein m is the number of ink discharge openings and d is the diameter of a dot.

After recording of each row, the sheet 2 is advanced by the recording width by means of the transport rollers 7, 8, and then the recording of a next row is conducted. The details of the transport mechanism are shown in FIG. 6.

The recording on the sheet 2 is conducted by the repetition of the above-explained operations, and, upon completion of recording of a sheet, the sheet 2 is discharged from the discharge rollers 12, 13 onto a discharge tray 14. FIG. 4 illustrates an example of the image recorded on the sheet 2.

FIG. 5 shows another example of transport mechanism of the conventional recording apparatus, in which transport rollers 7, 8 are positioned at the downstream side of the transport path for the sheet 2, with respect to the recording head 4, while pulling rollers 17, 18 are positioned at the upstream side. The pulling rollers 17, 18 have a transport amount somewhat smaller than that of the lower transport roller 7, and have a pinching force on the sheet 2 weaker than that of the transport rollers 7, 8, whereby the sheet 2 is maintained without slack under a suitable tension.

In the above-explained apparatus, however, in case the distance from the transport rollers to the rear end of sheet is less than 8 mm as shown in FIG. 2(*b*), the amount of sheet advancement becomes larger than 8 mm, (8 mm+$\alpha$), because the rear end of the sheet is released from the transport rollers in the course of sheet advancement as shown in FIG. 2(*c*) and the sheet is advanced thereafter by the discharge rollers only. Such fluctuation in the amount of sheet advancement may result in a deviation in the position of records.

More specifically, in the transport mechanism shown in FIG. 6, the transport rollers 7, 8 are positioned at the upstream side of the transport path with respect to the recording head 4, while the pull rollers 12, 13 are positioned at the downstream side, and the amount of advancement by said pull rollers 12, 13 is selected somewhat larger than that by the transport rollers 7, 8. After the rear end of the sheet 2 is released by the transport rollers 7, 8, the sheet 2 is transported by the pull rollers 12, 13 only. Consequently, with a motor rotating angle for the normal sheet advancement, the sheet is advanced more than it is released from the transport rollers, so that a high precise amount of advancement, in the order of 10 $\mu$m cannot be maintained.

In case a same stepping motor is used for driving the transport rollers and the pull rollers, and if said stepping motor rotates by a same amount without detecting the release of the sheet from the transport rollers, the sheet is advanced by a larger amount corresponding to the larger speed of the pull rollers.

For example, if the advancement of 8 mm is conducted by 100 pulses and if the pull rollers have a peripheral speed larger by 1%, said pull rollers advance the sheet by 8×1.01= 8.08 mm corresponding to 100 pulses, thus resulting in an excessive advancement by 80 microns.

Consequently the high precision recording on the sheet 2 is possible only while the sheet 2 can be precisely advanced by the lower transport roller 7. Therefore, the highly precise recording has to be completed until the sheet 2 is released by the transport rollers 7, 8 so that, as shown in FIG. 6, the blank area x at the rear end of the sheet 2 becomes inevitably large.

Also in the transport mechanism shown in FIG. 5, in which the transport rollers 7, 8 are positioned at the downstream side of the transport path with respect to the recording head 4 while the pull rollers 17, 18 are positioned at the upstream side, wherein the amount of transportation by said pull rollers 17, 18 is selected to be somewhat less than that of the transport rollers 7, 8, the amount of advancement of the sheet becomes less for a same amount of motor rotation, until the leading end of the sheet 2 is pinched by the transport rollers 7, 8. Consequently the highly precise recording has to be completed while the sheet 2 is transported by the pull rollers 17, 18 only, so that, as shown in FIG. 5, the blank margin x' at the leading end of the sheet 2 becomes inevitably large.

In the following there will be further considered the range enabling high precision recording, with reference to FIG. 7.

For a sheet advancement of 20 mm at the start of recording and a sheet advancement of 8 mm at each step, the amount transportable by the transport rollers at the last step is correlated with the length of the sheet, as shown in FIG. 7B. Therefore, in order to vary the amount of advancement in the last step, there is required means for detecting the transportable amount.

For this purpose use can be made of detection means shown in FIG. 8, consisting of a sensor arm 19-1 and a transmission sensor 19-2 for detecting the rear end of the sheet in the course of transportation thereof. Since the motor rotation passes through stages of acceleration, constant speed and deceleration as shown in FIG. 9 in the one-step advancement of the sheet 2, there is required a certain time for the sensor arm 19-1 to rotate to a position 19. Thus, if the rear end of the sheet 2 leaves the sensor arm 19-1 at a position A in FIG. 9, the sensor arm 19-1 rotates to the position 19 only at a time B. Thus generated is an error indicated by the hatched area, and the remaining amount at the rear end, calculated from the detection of the rear end of sheet, becomes a significantly different from the actual amount. This relation is shown in FIG. 10. As the detection means involves a significant error as explained above, the sheet advancement cannot be conducted with the transportable amount for the last step shown in FIG. 7B so that a large blank area at the rear end of the sheet has been unavoidable.

SUMMARY OF THE INVENTION

The principal object of the present invention is to provide an image forming apparatus capable of recording an image over as wide a range as possible on the recording medium with a satisfactory quality.

Another object of the present invention is to provide an image recording apparatus capable of expanding the recording range at the leading end or trailing end of the recording medium.

Still another object of the present invention is to provide an image forming apparatus capable of expanding the recording range regardless of the size of the recording medium.

The foregoing objects can be attained, according to an aspect of the present invention, by an image recording apparatus comprising:

recording means for recording an image on a recording medium according to recording information;

two recording medium transport means provided respectively at the upstream side and at the downstream side of a transport path, for transporting said recording medium; and recording control means adapted to control, for each recording unit of said recording means, the recording on the recording medium while it is not transported by said transport means of the upstream side and is transported only by said transport means of the downstream side.

Also the foregoing objects can be attained, according to another aspect of the present invention, by an image recording apparatus comprising:

recording means for recording an image on a sheet member;

first and second sheet transport means provided respectively on both sides of said recording means, wherein the amount of transportation by said first sheet transport means is different from that of said second sheet transport means; and transport amount control means for varying the amount of transportation between a situation wherein said sheet member is transported by either of said first and second sheet transport means and a situation wherein said sheet member is transported by cooperation of said first and second sheet transport means.

Furthermore, the foregoing objects can be attained, according to still another aspect of the present invention, by an image recording apparatus for effecting recording of a predetermined width on a sheet member by means of recording means, comprising:

transport means for transporting said sheet member, said transport means being adapted to repeat a step transportation of said sheet member by said predetermined width;

detection means for detecting the rear end of said sheet member;

counter means for counting the number of said step transportations of said sheet member until the detection of the rear end of said sheet member by said detection means; and control means for identifying the size of said sheet member based on the number of step transportations counted by said counter means and varying the amount of transportation of said sheet member and/or the recording area on said sheet member according to the size thereof.

BRIEF DESCRIPTION OF THE DRAWINGS

FIGS. 42A to 42C are views of a 7th embodiment.

DETAILED DESCRIPTION OF THE PREFERRED EMBODIMENTS

Now the present invention will be described in detail referring to embodiments shown in the attached drawings.

At first there will be explained a first embodiment of the image forming apparatus, applied to a serial ink jet printer adapted for use in a copying machine.

Figure 1:
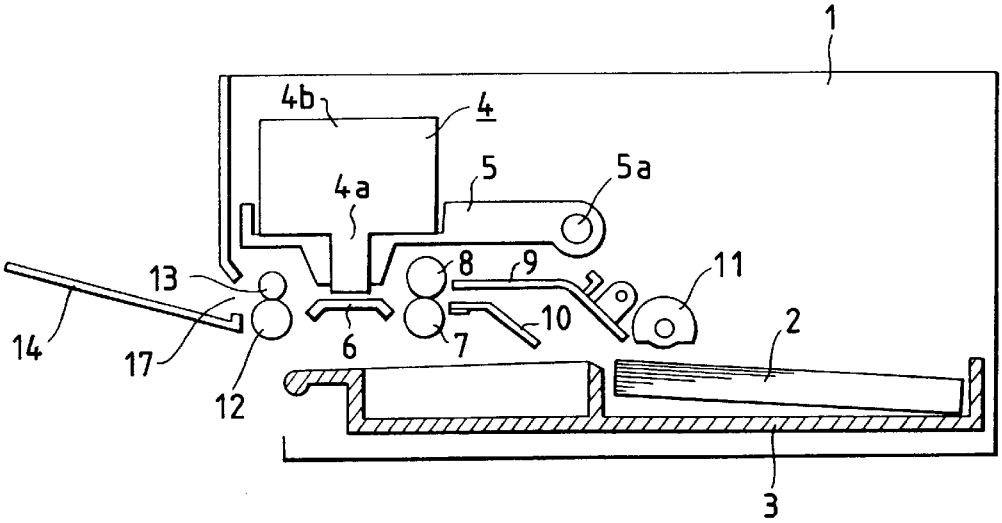
FIG. 1 is a cross-sectional view of an image recording apparatus in which the present invention is applicable.
Figure 11:
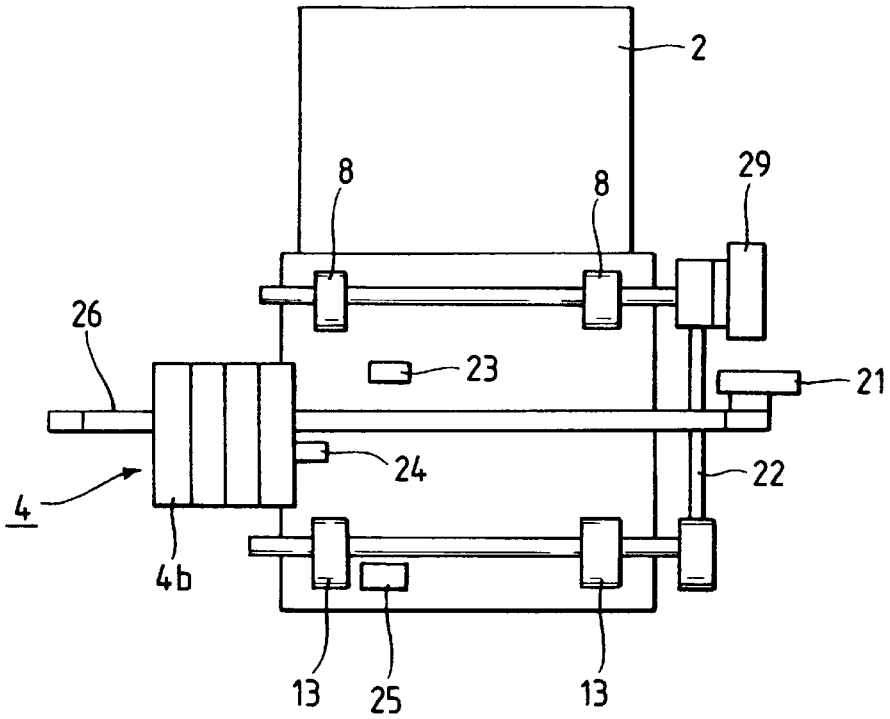
FIG. 11 is a plan view of an image forming apparatus constituting a first embodiment of the present invention.
Figure 12:
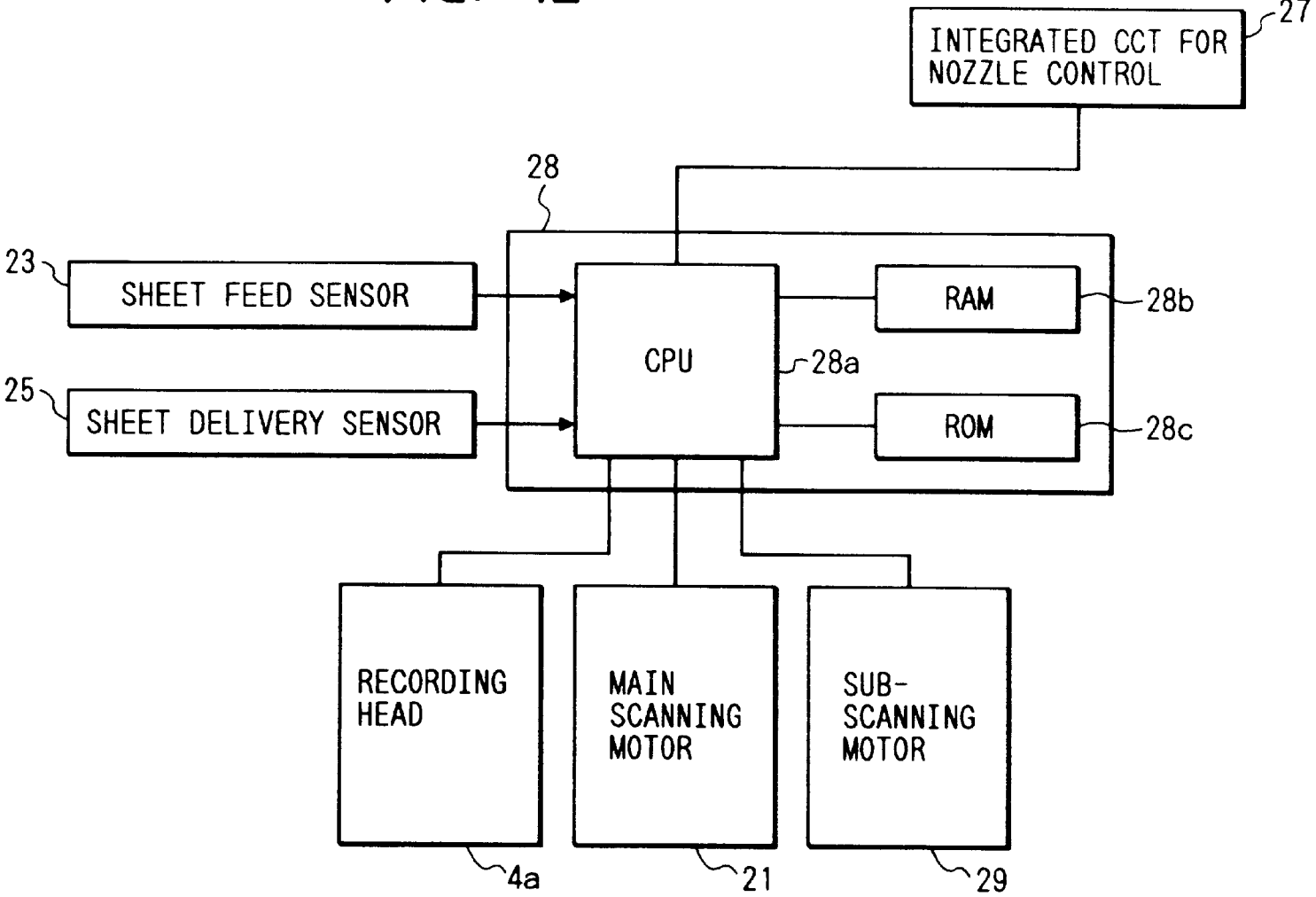
FIG. 12 is a block diagram of a control unit of said first embodiment.
Figure 13:
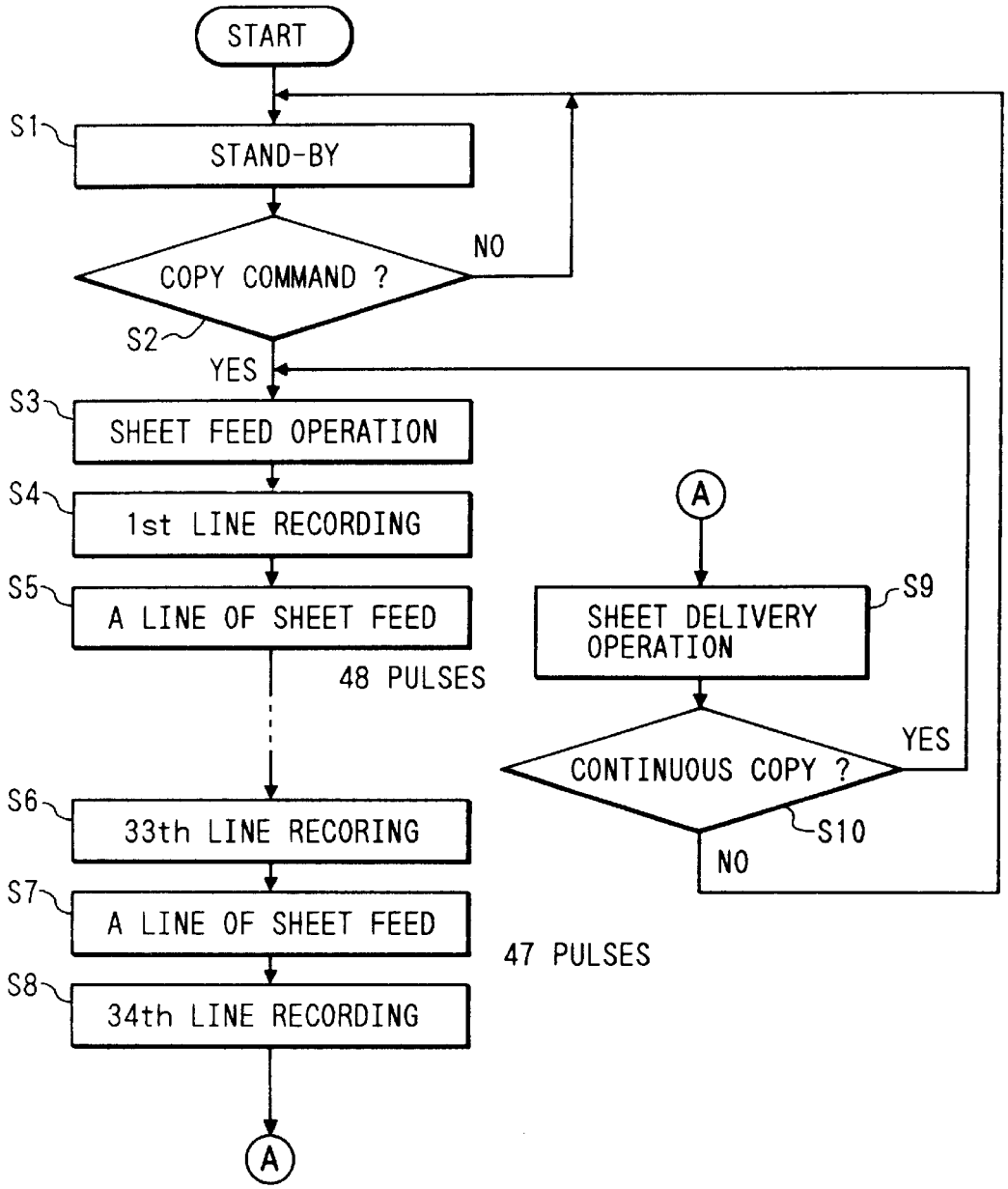
FIG. 13 is a flow chart showing the control sequence of said first embodiment.

FIG. 1 is a schematic cross-sectional view of a printer applicable to the 1st embodiment, FIG. 11 being a plan view thereof, FIG. 12 being a block diagram of a control unit of said printer, and FIG. 13 being a flow chart showing the control sequence thereof.

At first the structure of the printer will be explained with reference to FIGS. 1 and 11.

In these drawings there is shown an ink cartridge 4 for recording an image on a recording medium 2 according to recording information. Said ink cartridge 4 is integrally composed of a recording head 4*a* and an ink tank 4*b* and constructed to be replaceable. Said recording head 4*a* is provided with 128 nozzles (discharge openings), which are divided into 16 digits of 8 nozzles each, and the function of said nozzles can be controlled in the unit of said digit. Said recording head 4*a* is provided with plural liquid paths filled with liquid (ink). The ink in each liquid paths is, in the normal state, in equilibrium of surface tension and external pressure at the orifice plane. Each of said liquid paths is provided with an electrothermal converting element, which is given at least a drive signal for inducing a rapid temperature increase exceeding nucleate boiling, thereby generating thermal energy and causing film boiling in said ink. Thus a bubble is formed in the ink corresponding to said drive signal, and ink is discharged from the orifice plane toward the recording medium 2 by the growth of said bubble. Said bubble contracts by cooling with said ink, and the ink is replenished into the liquid path by capillary action from the ink tank 4*b*.

As explained above, growth or contraction of the bubble in the liquid path filled with ink can cause ink discharge from the orifice plane, thereby forming a liquid droplet. Thus the application of a pulsed drive signal to said electrothermal converting element according to image information causes instantaneous growth and contraction of the bubble, thereby discharging ink from the orifice plane of the recording head 4*a* toward the recording medium 2 and forming an image thereon. In the drawings, a numeral 6 indicates a platen for supporting the recording medium 2 transported to the recording position.

Said ink cartridge 4 is supported on a carriage 5 which can reciprocate in the main scanning direction (direction of width of the recording medium 2) along a guide shaft 5*a*. Said carriage 5 is driven by a main scanning motor 21 shown in FIG. 11, through a belt 26.

A cassette 3 can contain a stack of recording media 2 such as plain paper or OHP sheets, which are fed in succession toward the downstream side by a feed roller 11. The recording medium 2, fed by the feed roller 11, is guided by upper and lower guide members 9, 10 and supplied to paired transport rollers 7, 8 which are rotated by a sub scanning motor 29 as shown in FIG. 11. At the downstream side of said transport rollers 7, 8, there are provided paired discharge rollers 12, 13 for discharging the recording medium 2 after image recording by the above-explained recording means. As shown in FIG. 11, said discharge rollers 12, 13 are driven by said sub scanning motor 29, through a belt 22.

At the downstream side of said paired transport rollers 7, 8, as shown in FIG. 11, there is provided a sheet feed sensor 23 for detecting the recording medium 2 fed from said cassette 3.

Also said carriage 5 is provided with a sheet width sensor 24 for detecting the kind and width of said recording medium 2.

In the vicinity of the paired discharge rollers 12, 13 there is provided a sheet discharge sensor 25 for detecting the recording medium 2 discharged after image recording and the recording medium 2 at manual feeding. The above-mentioned sensors are composed of reflective sensors.

A discharge tray 14 in FIG. 1 is used for stacking the recording media 2 discharged from said paired discharge rollers 12, 13. An exit 17 for the recording medium 2 serves also as a feed entrance for manual sheet feeding.

In the following there will be explained the structure of a control unit of the above-explained printer, with reference to a block diagram shown in FIG. 12.

A control unit 28 is provided with a CPU 28*a* for executing the sequence of a flow chart to be explained later, a ROM 28*b* for storing fixed data such as a program corresponding to said sequence, a RAM 28*c* serving as a working area, etc.

Said control unit 28 receives detection signals from said sheet feed sensor 23 and sheet discharge sensor 25, and sends control signals to a recording head 4*a*, a main scanning motor 21, a sub scanning motor 29 and a head controlling integrated curcuit 27.

In the following explained is the control sequence of said control unit 28, with reference to a flow chart shown in FIG. 13.

At first, in a step S1, the recording media 2 are stacked in the cassette 3 as shown in FIG. 1, and there is awaited the input from a record start key.

Then a step S2 discriminates whether the input for starting the recording is present, and, if present, the sequence proceeds to a step S3 for starting the recording operation. If said input is absent, the stand-by state for awaiting said input is continued.

When the recording operation is started, the step S3 effects feeding of the recording medium 2 from the cassette 3. Manual sheet feeding may be conducted from the entrance 17. Also the sub scanning motor 29 is activated to rotate the transport rollers 7, 8 and the discharge rollers 12, 13 thereby transporting the recording medium 2.

Then a step S4 starts the recording of the first line.

The recording operation for plain paper is conducted in steps S4–S10 in the following manner.

The recording of the 1st line is conducted by ink discharge from the discharge openings of the recording head 4*a* according to the recording information, simultaneously with the movement of the ink cartridge, incorporating said recording head 4*a*, in the main scanning direction together with the carriage 5 (step S4). After the recording of a line, the paired transport rollers 7, 8 are rotated to advance the recording medium 2 in the sub scanning direction (transport direction of the recording medium 2) by a length corresponding to a line. At the same time, the front end side of the recording medium 2 is supported and transported by the paired discharge rollers 12, 13 (step S5). Subsequently the recording of a 2nd line is conducted in a similar manner.

In case the recording medium 2 is composed of a recording sheet for example of A4 size, the sheet advancement of a line corresponds to 48 pulses for said sub scanning motor 29. The apparatus of the present embodiment records 34 lines on an A4-sized recording sheet.

A step S6 effects the recording for a 33rd line. Then a step S7 effects sheet feeding by a line pitch, from the 33rd line to the 34th line, with 47 pulses for the sub scanning motor 29.

Figure 2:
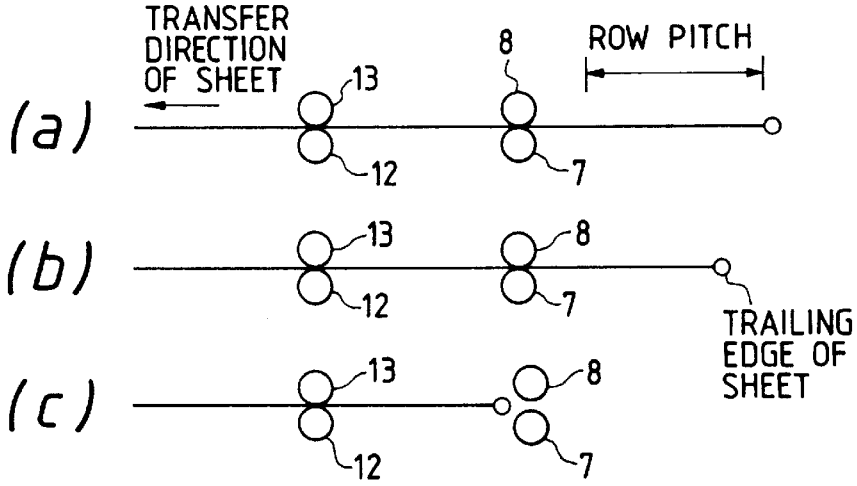
FIG. 2 is a schematic view showing the mode of transportation of the recording medium in the image recording apparatus shown in FIG. 1.
Figure 3:
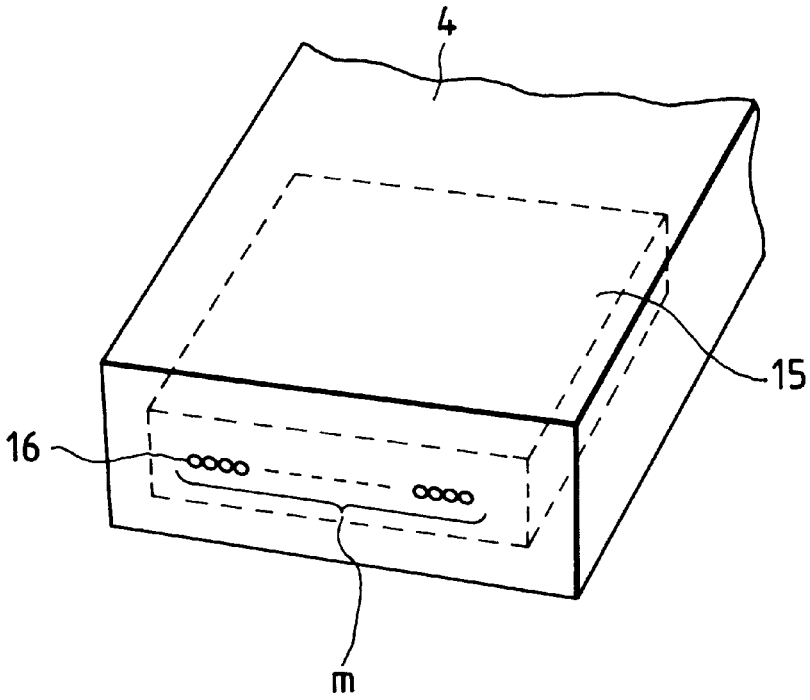
FIG. 3 is a perspective view of a recording head shown in FIG. 1.
Figure 4:
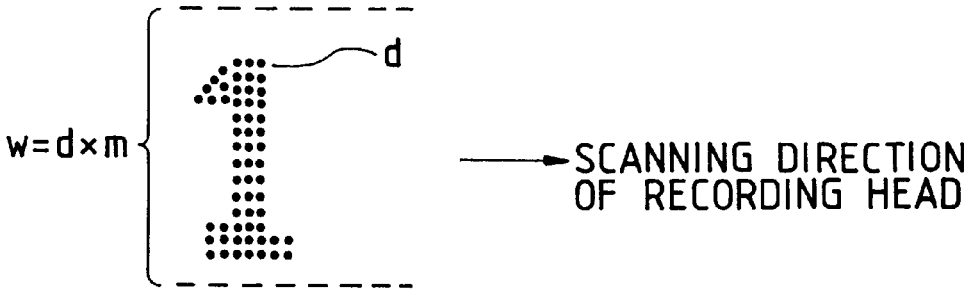
FIG. 4 is a view showing an example of the image recorded by the recording head shown in FIG. 3.
Figure 14:
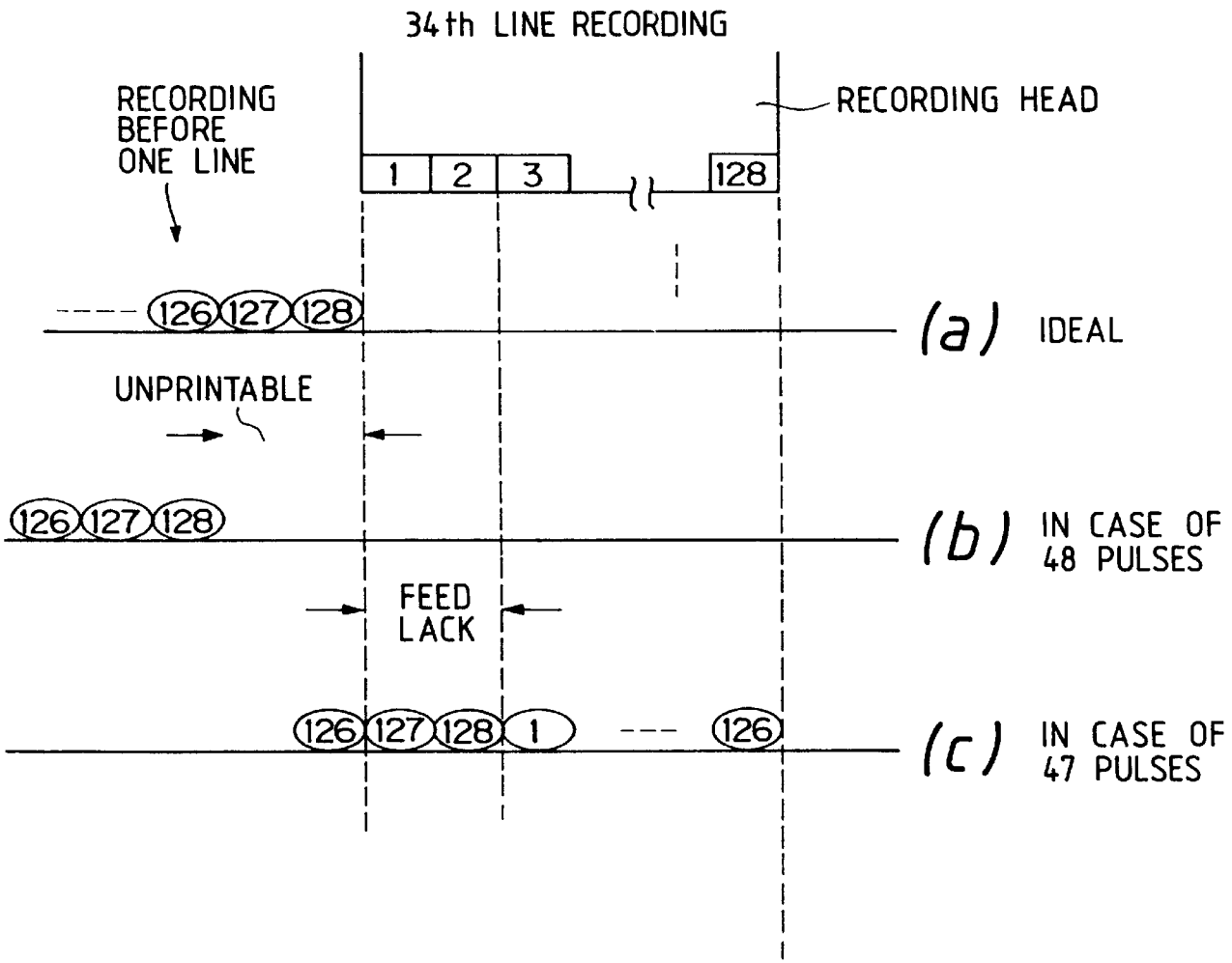
FIG. 14 is a schematic view showing the recording of a last line in said first embodiment.

The reason for using 47 pulses for sheet feeding will be explained in the following, with reference to FIGS. 2(*c*), 14(*a*), (*b*) and (*c*). If the distance from the transport rollers 7, 8 to the rear end of the recording sheet 2 is shorter than the line pitch (8 mm in this example), said sheet 2 is released from said rollers 7, 8 in the course of sheet feeding as shown in FIG. 2(*c*), and is thereafter advanced by the discharge rollers 12, 13 only. Since the amount of sheet feeding of the discharge rollers 12, 13 is selected larger than that of the transport rollers 7, 8 in order to provide the recording sheet 2 with a certain tension, a sheet feeding with 48 pulses in the step S7 will result in an excessive advancement as shown in FIG. 14(*b*). For this reason, in the present embodiment, the sheet advancement is conducted with 47 pulses as shown in FIG. 14(*c*), thereby avoiding such excessive advancement.

More precisely, however, said sheet advancement with 47 pulses is slightly short of the desired amount of advancement, for example by about two pixels. Therefore, if the recording is conducted in such state of deficient advancement, the line pitch between the 33rd line and the 34th line becomes slightly smaller. In the present embodiment, said deficiency of two pixels is corrected by the nozzle control of the recording head.

Figure 15A:
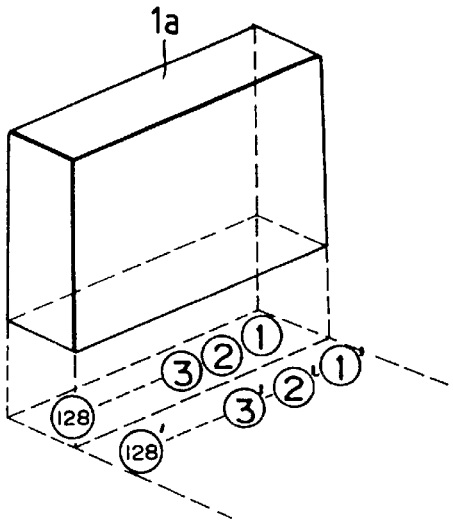
FIGS. 15A and 15B are schematic views showing nozzle control in an ink jet recording head employable in the first embodiment.
Figure 15B:
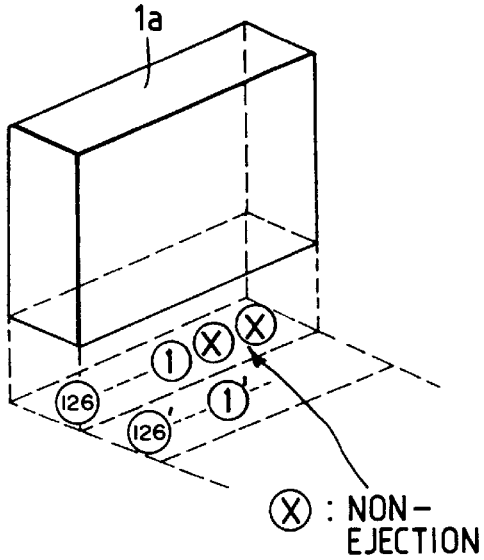

More specifically, a step S8 records the last (34th) line with nozzle control of the recording head, thereby compensating the above-mentioned deficient sheet advancement. In the normal recording up to the 33rd line, the 1st to 128th nozzles discharge ink corresponding to data 1 to 128, as shown in FIG. 15A. In the recording of the 34th (last) line, as shown in FIG. 15B, the nozzles are so controlled that the 1st and 2nd nozzles do not discharge ink, and that the 3rd to 128th nozzles function respectively corresponding to data 1 to 126.

In the following there will be explained the recording operation of a line in the step S4, S6 and S8 in FIG. 13.

Figure 17:
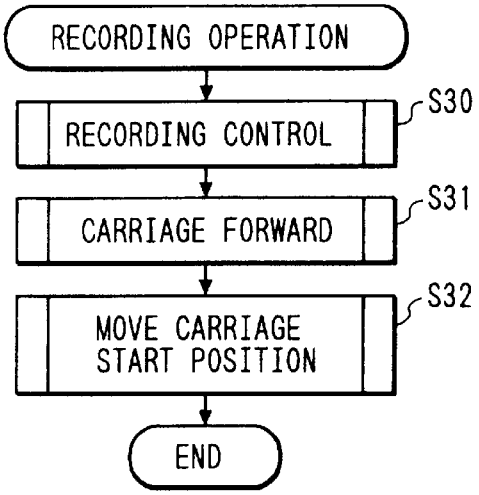
FIGS. 17 to 19 are flow charts showing partial details of the flow chart shown in FIG. 13.

FIG. 17 is a flow chart showing the outline of the recording operation of a line. At first a step S30 sets the recording control mode, for controlling the nozzles to be driven and the ink discharge force. Then a step S31 effects recording by discharging ink from the nozzles while the carriage 5 is moved in the main scanning direction. After the recording of a line, a step S32 returns the carriage 5 to a start position, thereby preparing for the recording of a next line.

Figure 18:
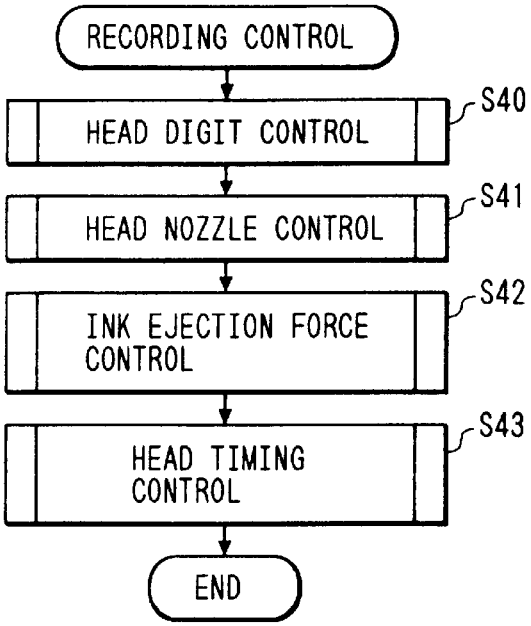
Figure 19:
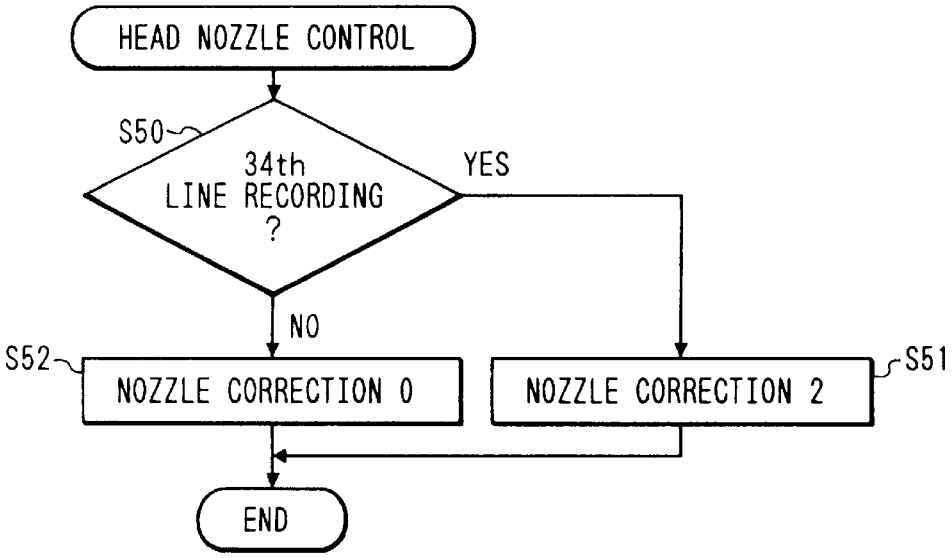

The details of the recording control in said step S30 are shown in a flow chart shown in FIG. 18. At first a step S40 selects, among 16 digits, those to be used for recording. This selection is useful for example in case only a half of the digits is used for example in reduced-size recording. Then a step S41 selects, among 128 nozzles, those to be used for recording. The details of this step are shown in FIG. 19, and said selection is conducted according to the serial number of the line to be recorded. More specifically, a step S50 discriminates whether the recording is on the 34th line, and, if so, a step S51 effects correction for two pixels. If otherwise, a step S52 sets the nozzle correction at "0" (no correction).

Then a step S42 in FIG. 18 effects control on the ink discharging force, and a step S43 effects control on the drive timing of the recording head.

Subsequently a step S9 effects sheet discharge, and a step S10 discriminates whether a continuous copying operation is instructed.

Even in a situation where the recording sheet 2 is released from the transport rollers 7, 8 and is transported by the discharge rollers 12, 13 only and the distance from the discharge rollers 12, 13 to the rear end of said sheet 2 is less than the line pitch, the present embodiment enables to record the last line (34th line in this case) without positional aberration on the sheet 2, by means of a variation in the number of driving pulses for the sub scaning motor 29 and a control on the nozzles of the ink jet recording head 4*a*. Besides, though the control on the position of the last line only has been described in the present embodiment, it is also possible to control the position of the last several lines in the course of transportation of the recording sheet 2 by the discharge rollers 12, 13 only, in case the distance between said discharge rollers 12, 13 and the transport rollers 7, 8 is equal to several line pitches.

Also the above-explained embodiment is limited to the control on the main body and the ink jet recording head, but it is applicable for controlling the recording position of the last line in other dot printers, such as a wire dot printer, a thermal dot printer or a beam jet recording head.

Figure 16:
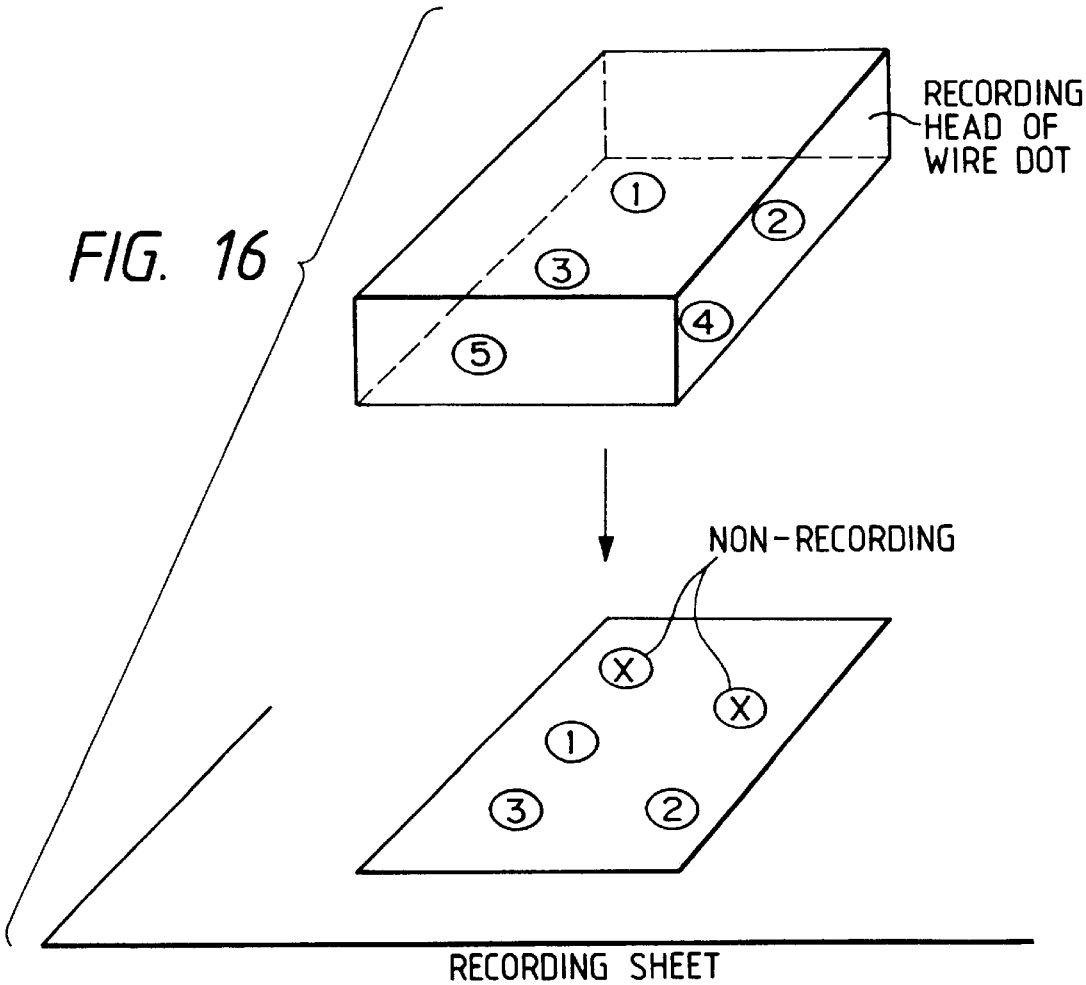
FIG. 16 is a schematic view showing recording control of a wire dot recording head employable in the first embodiment.

For example, in a recording head of a wire dot printer as shown in FIG. 16, the fine adjustment of the recording position of the last line can be achieved by controlling the protrusion and retraction of wires at specified positions. In the ordinary recording, the recording of data 1–5 is conducted with wires (1) to (5). In the recording of the last line, the wires (1) and (2) are not used for recording, and the wires (3) to (5) respectively record the data 1–3. Such control enables correction of the pixels corresponding to the deficient sheet advancement, so that the last line can be recorded without positional deviation.

Also the foregoing embodiment has only described the case of using an A4-sized recording sheet, but it can achieve the recording of the last line without positional deviation in other sheet sizes such as B5 or A6 size.

In such case, if the recording sheet is of a predetermined size, information on the sheet size may be set prior to the process shown in FIG. 13 in order to recognize the timing of recording of the last line from the entered line pitch and sheet size information. The entry of said informaiton may be conducted automatically or manually as used in the known copying machine or recording apparatus.

Also there may be provided suitable means for measuring the distance from the transport rollers to the rear end of the sheet, whereby the entry of such size information may be dispensed with and the recording media of arbitrary sizes other than those of A- and B-series may be handled.

Besides the line pitch and the number of steps of the motor are not limited to those described above but may be suitably selected, and the number of decrease in pulses at the rear end of sheet can naturally be selected arbitrarily.

In the foregoing embodiment, the change in the amount of sheet advancement immediately prior to the recording of the last line is achieved by varying the number of pulses for the sub scanning motor 29 from 48 to 47, but said change may also be attained by mechanical means. It is for example possible to vary the amount of advancement by the transport rollers and the discharge rollers by connecting several sub gears of different gear ratios to the gear of the sub scanning motor 29 shown in FIG. 11 and suitably switching said sub gears.

Furthermore, the transport means for the recording medium is not limited to the paired rollers in the foregoing embodiment but may assume other configurations.

As explained in the foregoing, the present invention enables recording for example of the last line without positional deviation even when the distance from the transport rollers to the rear end of the sheet is less than a line pitch, thereby realizing satisfactory image recording in a wider range of the recording sheet.

In the following there will be explained a second embodiment of the present invention, with reference to the attached drawings.

Figure 6:
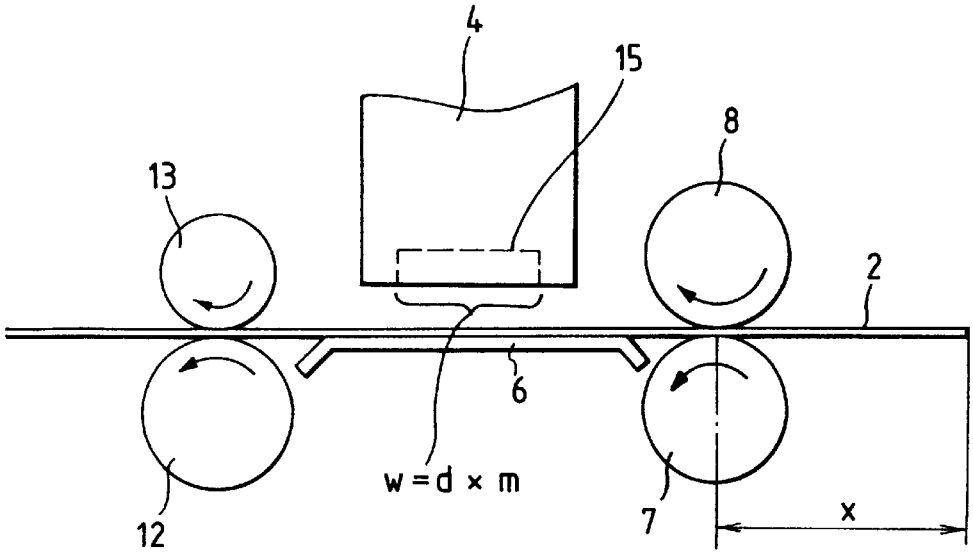
Figures 7A, 7B:
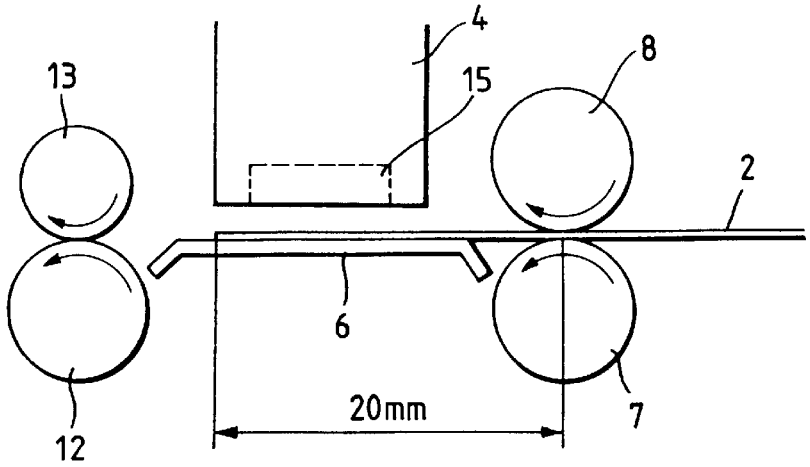
Figure 20:
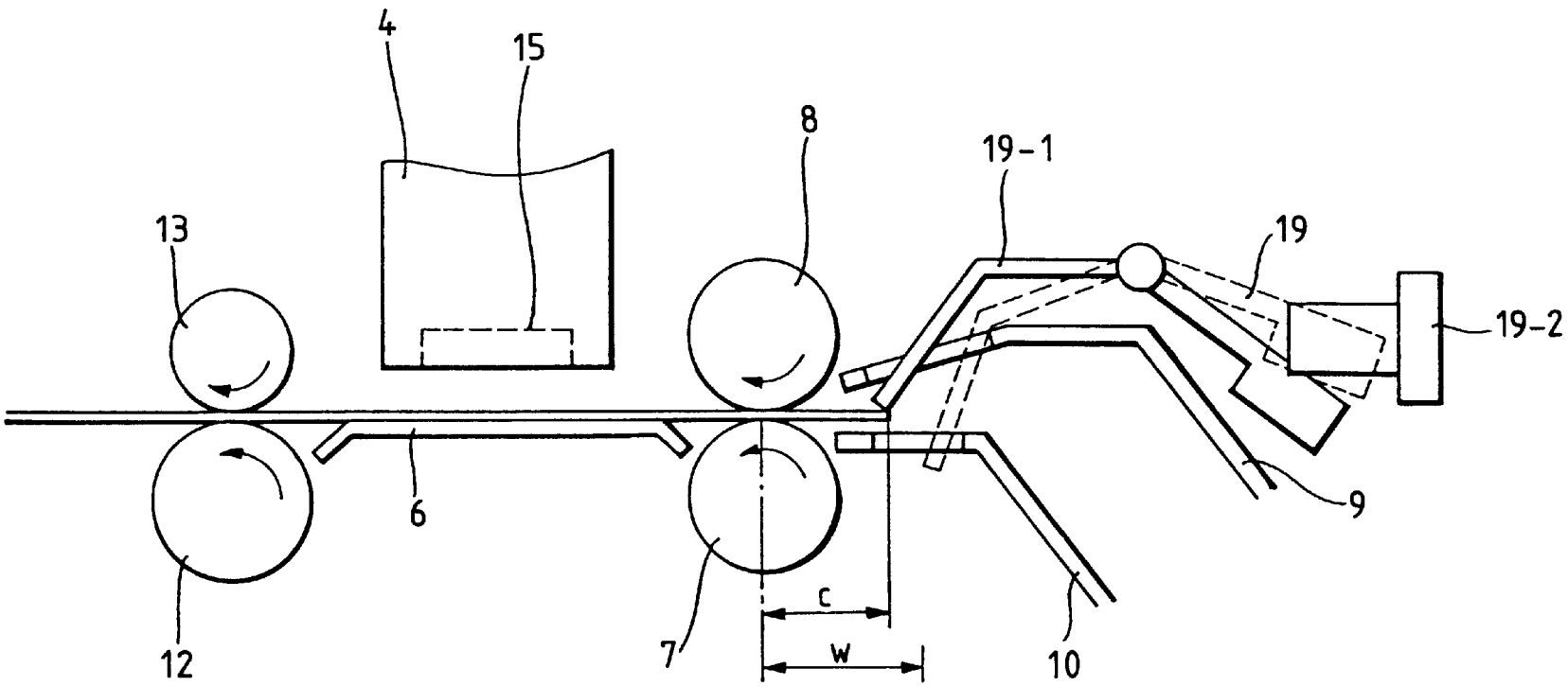
FIG. 20 is a schematic view of a second embodiment of the present invention.

FIG. 20 is a schematic view of an image recording apparatus constituting a second embodiment of the present invention, wherein equivalent components to those in FIGS. 1 and 6 are represented by the same reference numerals. There are provided a sensor arm 19-1 and a transmission sensor 19-2 consisting of a light emitting unit and a photosensor unit. These members constitute a sheet sensor 20 for detecting the rear end of the sheet. During detection of the sheet, the sensor arm is in the solid-lined position, whereby the light from the light emitting unit reaches the photosensor unit. In the non-detecting state, the sensor arm 19-1 is in the broken-lined position, whereby the light from the light emitting unit is intercepted by said sensor arm. The sheet sensor 20 detects the rear end of the sheet from the change between these states.

Figure 21:
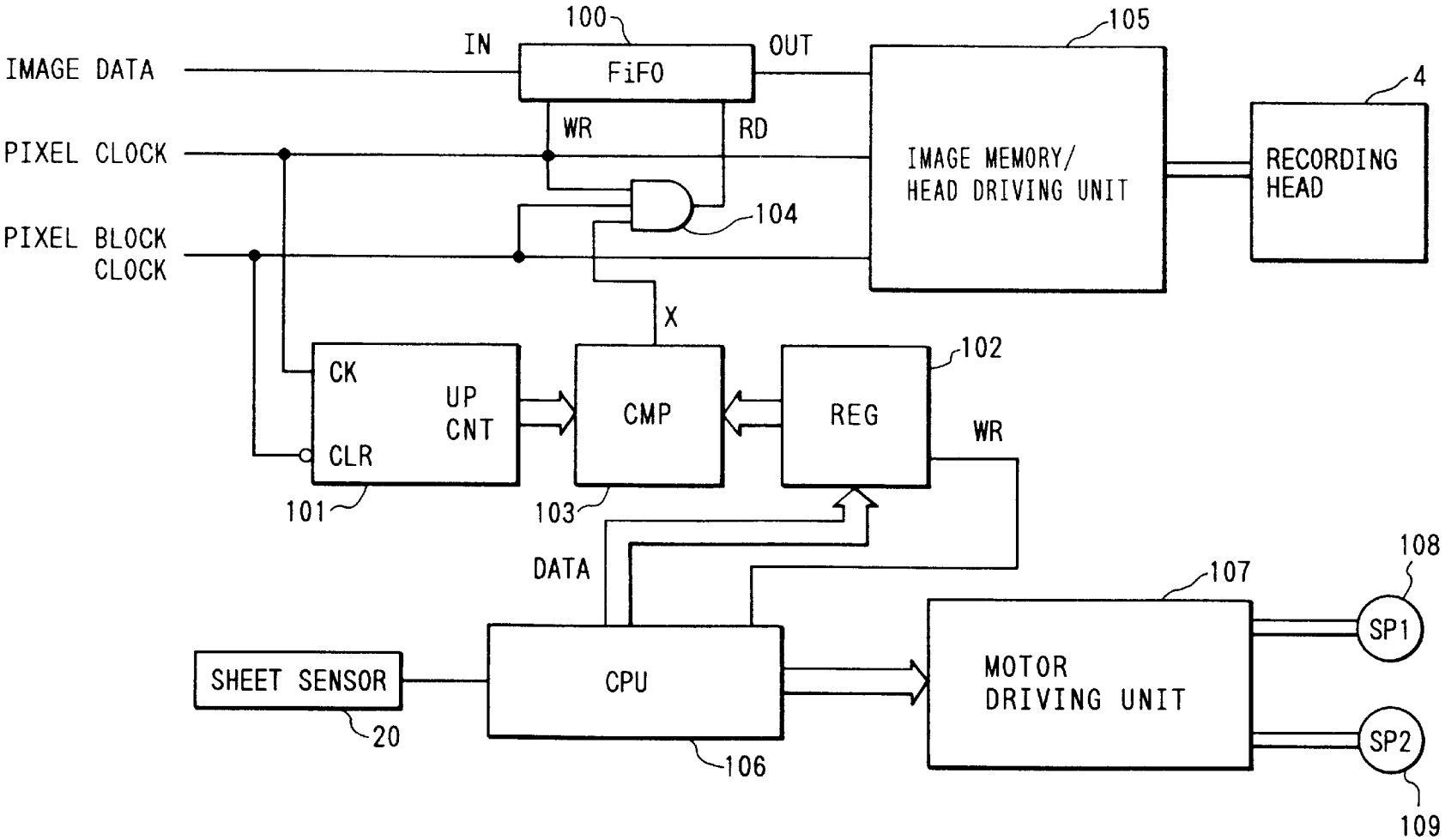
FIG. 21 is a block diagram showing the control system of said second embodiment.

FIG. 21 is a block diagram of the circuit structure of the 2nd embodiment.

Figure 22:
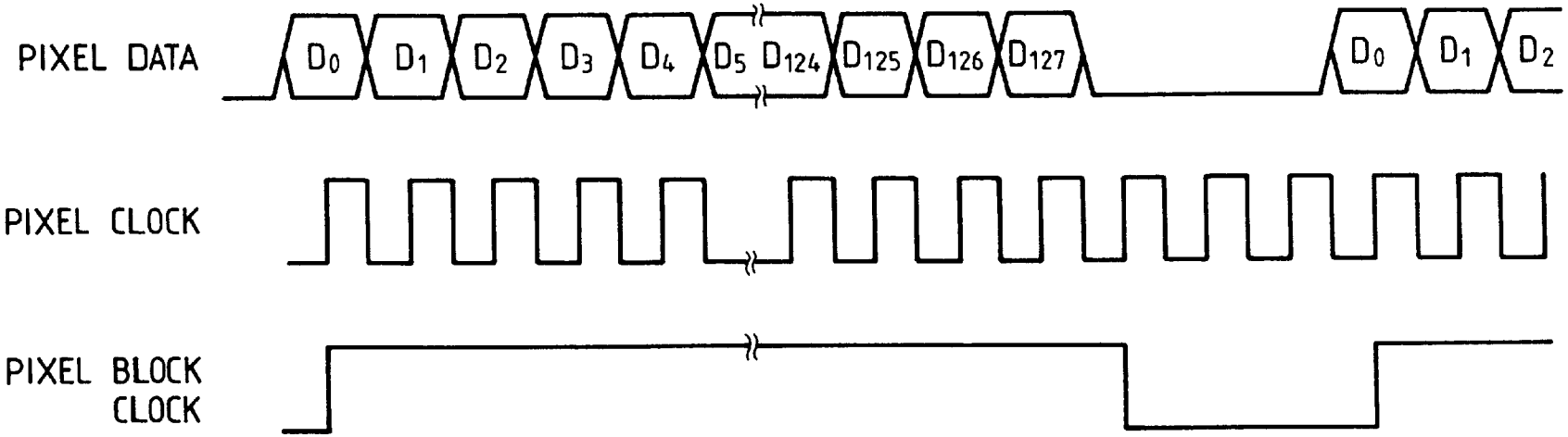
FIG. 22 is a timing chart showing the relationship among image data, pixel clock signals and pixel block clock signals.

An up-counter 101 counts pixel clock signals, and is reset by a pixel block clock signal. The pixel block clock signal indicates the effective area of the image data, and corresponds to 128 pixel clock signals. A register 102 stores a correction value for the dot print position, set by a CPU 106. A comparator 103 compares the count of the up-counter 101 and the correction value in the register 102, and releases a signal X if both are equal or said count is larger. An AND gate 104 calculates logic product of the output of the comparator 103, pixel clock signal and pixel block clock signal, and therefore releases the pixel block signals with a delay corresponding to the correction value set in the register 102. A FIFO memory 100 for temporarily storing the image data stores the image data in synchronization with the pixel clock signals and releases said image data in synchronization with the output signals of the AND gate 104. FIG. 22 shows the relationship of the image data, pixel clock signals and pixel block clock signals. An image memory/head driving unit 105 stores the image data from the FIFO memory 100 and drives a recording head according to the stored image data. There are also provided a stepping motor 108 for effecting scanning motion of the recording head, and a stepping motor 109 for sheet feeding. A sensor 20 detects the rear end of the recording sheet. A motor driving unit 107 drives the stepping motors 108, 109 based on the amount of rear end determined by said sheet sensor.

In the following a detailed explanation will be given on the transport method for the sheet member 2.

After recording of each line by the recording head 4, the sheet member 2 is advanced by a lower transport roller 7 by an amount equal to the recording width W. However the roller contributing to the sheet advancement becomes different, depending on the magnitude of the remaining amount x at the rear end. More specifically, depending on the remaining rear-end length x from the rear end of the sheet 2 to the nip of the lower transport roller 7;

(1) if x≧W:
the next advancement of the sheet 2 is conducted by the lower transport roller 7;

(2) if 0<x<W:
the sheet 2 is advanced by the lower transport roller 7 to a point of distance x from the rear end, and is thereafter transported by the lower pulling roller 12;

(3) if x≧0:
the sheet 2 is advanced by the lower pulling roller 12.

Also the amount l of advancement of the sheet 2 is given by:

n: number of pulses of the stepping motor required for advancing the sheet 2 by the recording width W by the lower transport roller 7;

t: amount of advancement by the lower transport roller 7, by a pulse of the stepping motor; and e: ratio of the amount of advancement by the lower pulling roller 12 to that of the lower transport roller 7, (1) if x≧W:
l=nt;

(2) if 0<x<W:

$$l = x + (nt - x)e$$
$$= -(e-1)x + nte;$$

(3) if x≧0:
l=nte, wherein nt=W=md.

Figure 23:
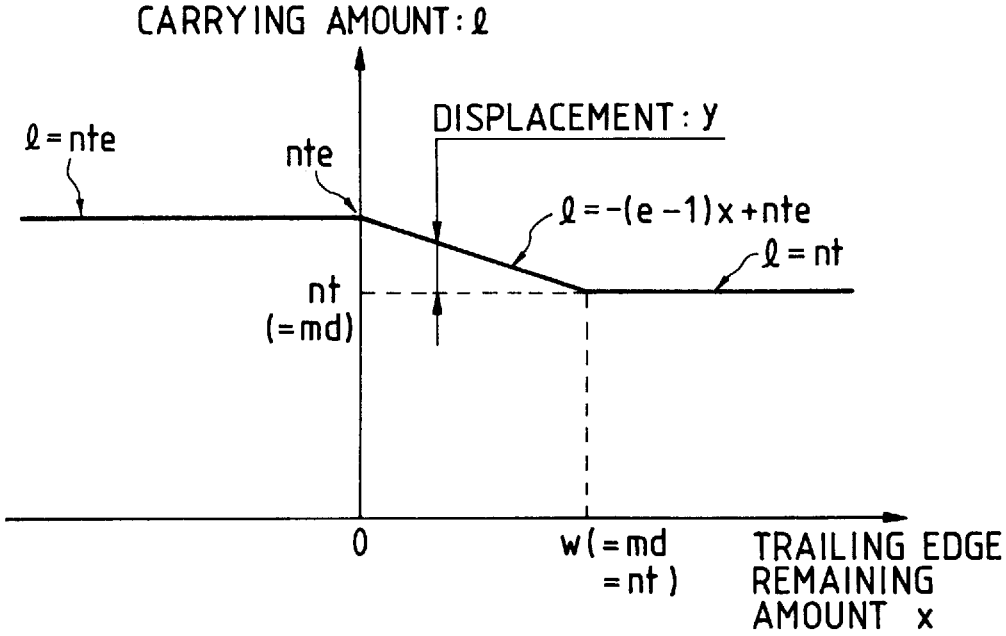
FIG. 23 is a chart showing the relation between the remaining amount x at rear end and the transporting amount y.

These relations are shown in FIG. 23.

Thus the deviation or displacement y of advanced amount l from the recording width W=nt is:

(1) if x≧W:
y=0;

(2) if 0<x<W:

$$y = -(e-1)x + nte - nt$$
$$= -(e-1)x + (e-1)nt$$
$$= (nt - x)(e-1);$$

(3) if x≦0:

$$y = nte - nt$$
$$= nt(e-1).$$

Said displacement y is preferably equal to zero, but in practice becomes larger for example because of the ratio e, thus becoming eventually unable to satisfy the required accuracy of advancement of the sheet 2.

Then, the advancing amount l of the sheet 2 when the number of pulses for the stepping motor is reduced by r, namely with (n−r) pulses, is given by:

(a) if x≧W−rt:
l=(n−r)t;

(b) if 0<x<W−rt:

$$l = x + \{(n-r)t - x\}e$$
$$= -(e-1)x + (n-r)te$$
$$= -(e-1)x + nte - rte;$$

(c) if x≦0:
l=(n−r)te.

Figure 24:
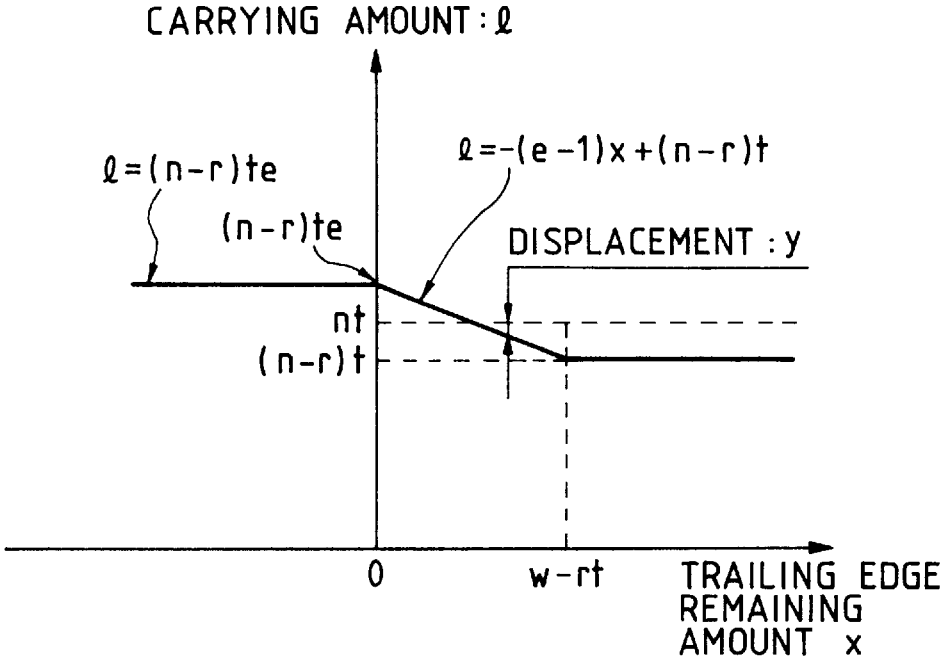
FIG. 24 is a chart showing the relation between the remaining amount x at rear end and the transporting amount y.

These relations are shown in FIG. 24.

The displacement y in this case is:

(a) if x≧W−rt:
y=(n−r)t−nt=−rt;

(b) if 0<x<W−rt:

$$y = -(e-1)x + (n-r)te - nt$$
$$= -(e-1)x + nt(e-1) - rte;$$

(c) if x≦0:

$$y = (n-r)te - nt$$
$$= nt(e-1) - rte.$$

Thus the transported amount l of the sheet 2 may become smaller than the recording width W depending on the magnitude of r and e, whereby the records of adjacent lines mutually overlap by the amount of said aberration y.

By suspending the ink discharge for such over-lapping dots of a number m', the recording width becomes W−m'd=nt−m'd. Thus the aforementioned aberration y is represented by:

$$y = l - (nt - m'd)$$

and becomes:

(1) if x≧W−rt:
y=(n−r)t−(nt−m'd)=−rt+m'd;

(2) if 0<x<W−rt:

$$y = -(e-1)x + (n-r)te - (nt - m'd)$$
$$= -(e-1)x + (e-1)nt - rte + m'd;$$

(3) if x≦0:

$$y = (n-r)te - (nt - m'd)$$
$$= nt(e-1) - rte + m'd.$$

Thus, in case of (b), the reduced pulse number r and the overlapping dot number m' may be selected so as to minimize the absolute value of the deviation y, as a function of x. Also in case of (a) or (c), the reduced pulse number r and the overlapping dot number m' may be similarly selected so as to minimize said absolute value of the deviation y.

Figure 25:
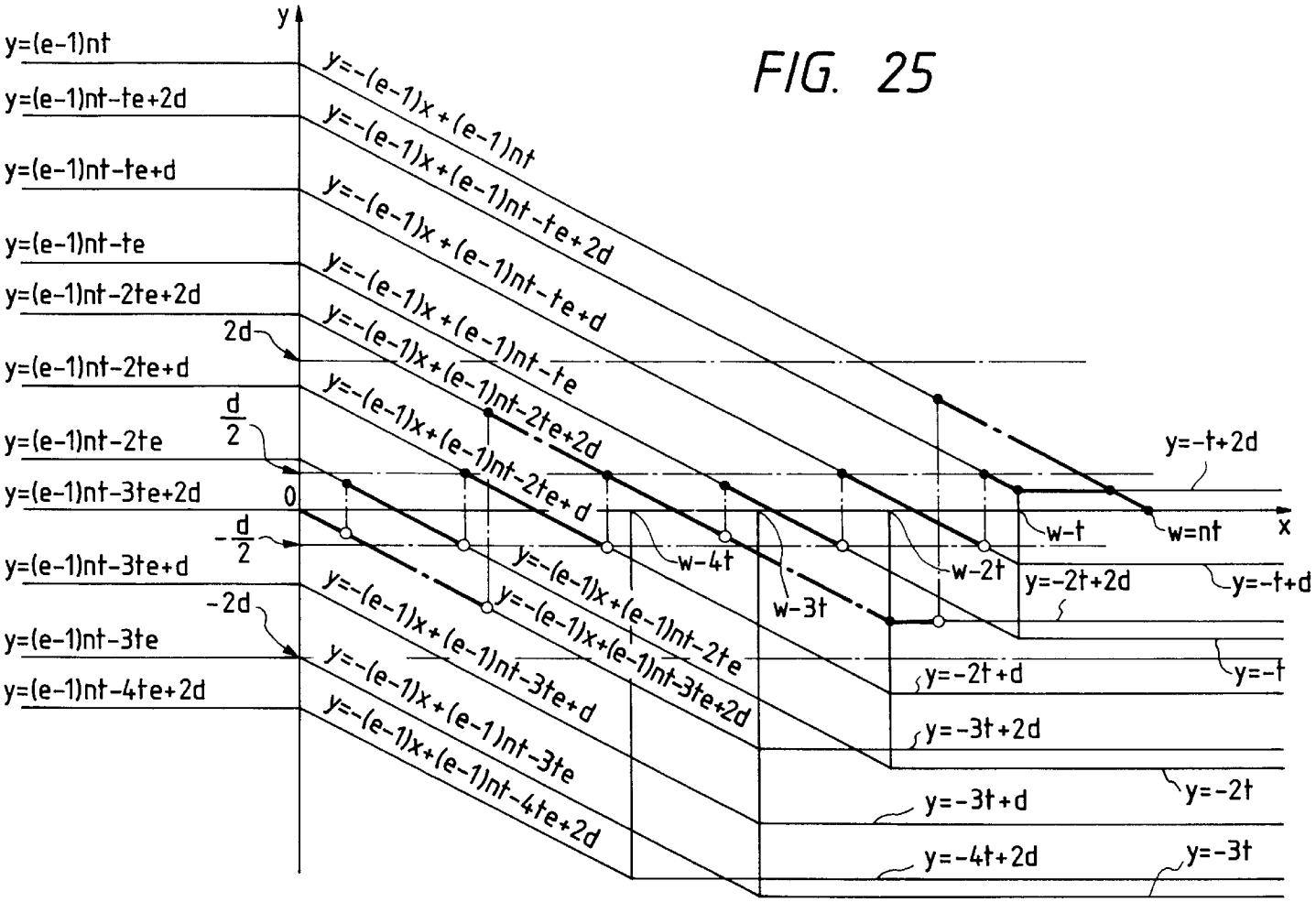
FIG. 25 is a chart showing the rear end process.

These relationships are shown in FIG. 25. From FIG. 25 it will be understood that the absolute value of the deviation y can be minimized by taking relations represented by thick solid lines. In this case the maximum aberration is one dot d (±d/2). If the tolerance for the deviation y is selected as ±2d, there may be adopted relations represented by thick chain lines, and the number of correction patterns can be reduced.

As explained in the foregoing, an optimum correction can be attained by suitably selecting the parameters in the equation for determining the deviation y, and the tolerance for the deviation y. In the present embodiment, the pulling rollers 12, 13 are driven in linkage with the transport rollers 7, 8, but they may be independently driven. For example the pulling rollers may be rotated after the transport rollers are stopped.

In the following there will be explained the method of detecting the rear end of the sheet member 2. In the following it is assumed that the remaining amount at the rear end is in a range of 0–W, and that there are provided two correcting means.

Figure 26:
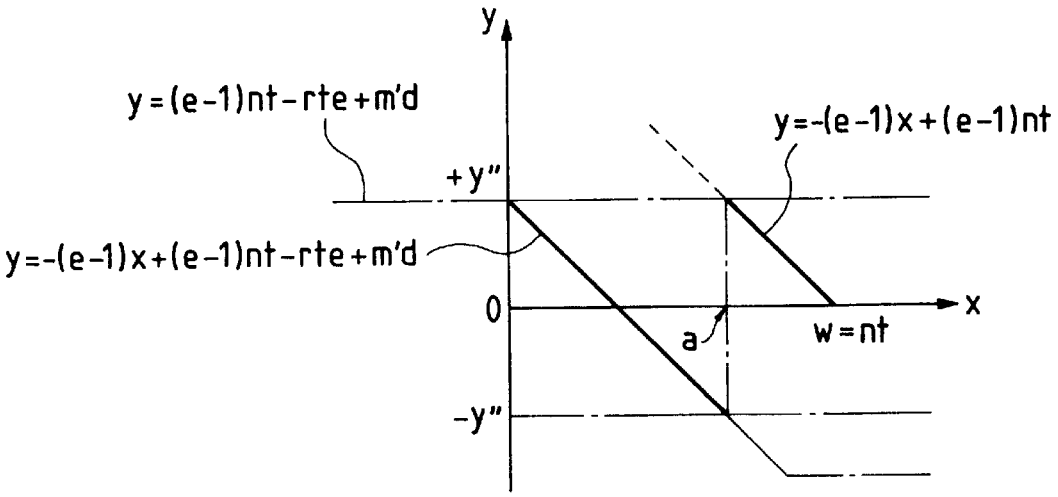
FIG. 26 is a chart showing the relation between the remaining amount x at rear end and the error y.

In this case, the deviation y can be maintained within a tolerance ±y" as shown in FIG. 26. In case the rear-end remaining amount x is in a range $0<x\leqq a$, the value y becomes minimum according to $y=-(e-1)x+(e-1)nt-rte+m'd$ (correction with r pulses and m' dots), and, in case of $a<x<nt$, y is minimized by $y=-(e-1)x+(e-1)nt$ (no correction as in the conventional case).

Thus it is necessary to discriminate whether the rear-end remaining amount x is larger or smaller than a. Therefore, in the sensor arm shown in FIG. 20, the detecting position is set at c=a. The sheet advancement is conducted with nt pulses, and, if the sensor arm 19 is in the solid-lined position shown in FIG. 20 in the stopped state (when the sheet 2 is not advanced), the next advancement is also conducted with nt pulses. On the other hand, if the sensor arm 19 is in the broken-lined position in FIG. 20 at the stopped state, correction is conducted in the next step by effecting the advancement with (n−r)t pulse and suspending the ink discharge for m' dots. In this manner the displacement can be maintained within ±y". From FIG. 26 it will be apparent that a relation c=a<W stands. However, as nt is constant, there may be selected a position c'=a+Nnt (N being a positive integer). Stated differently, it is possible to send nt pulses N times, and to effect correction in the next step.

In the present embodiment, there are employed the following parameters:

dot diameter d: 0.0635 mm;

number m of ink discharge openings: 128;

recording width W (=md): 8.128 mm;

pulse number n required for advancement of W: 48 pulses;

amount of advancement t (=W/n) by transport roller per pulse: about 0.1693 mm/pulse;

ratio of amount of transportation by pulling roller to that by transport roller: 1.01, and the following two control modes (1) and (2) are switched according to the rear-end remaining amount x:

(1) if $x\geqq 5.927$:
advancement by stepping motor: 48 pulses;
correction for print dot position: 0 dot (no correction);

(2) if $x<5.927$:
advancement by stepping motor: 47 pulses;
correction for print dot position: 2 dots.

Figure 27:
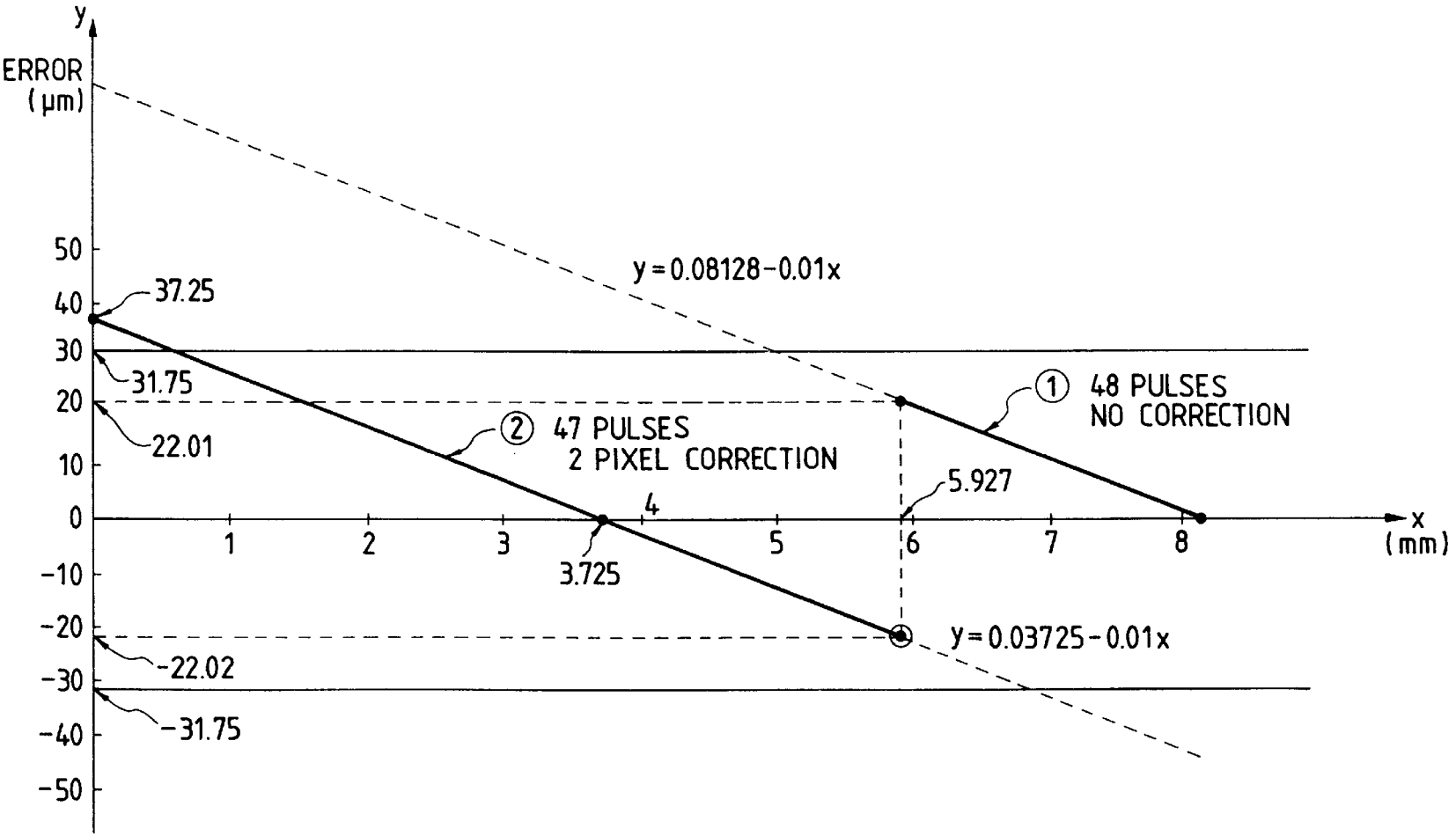
FIG. 27 is a chart showing a rear end process by a pull roller with a transporting amount increased by 1%.

In this manner, the error in the print position can be maintained within about d/2, namely without 0.03175 mm, as shown in FIG. 27.

Figure 28:
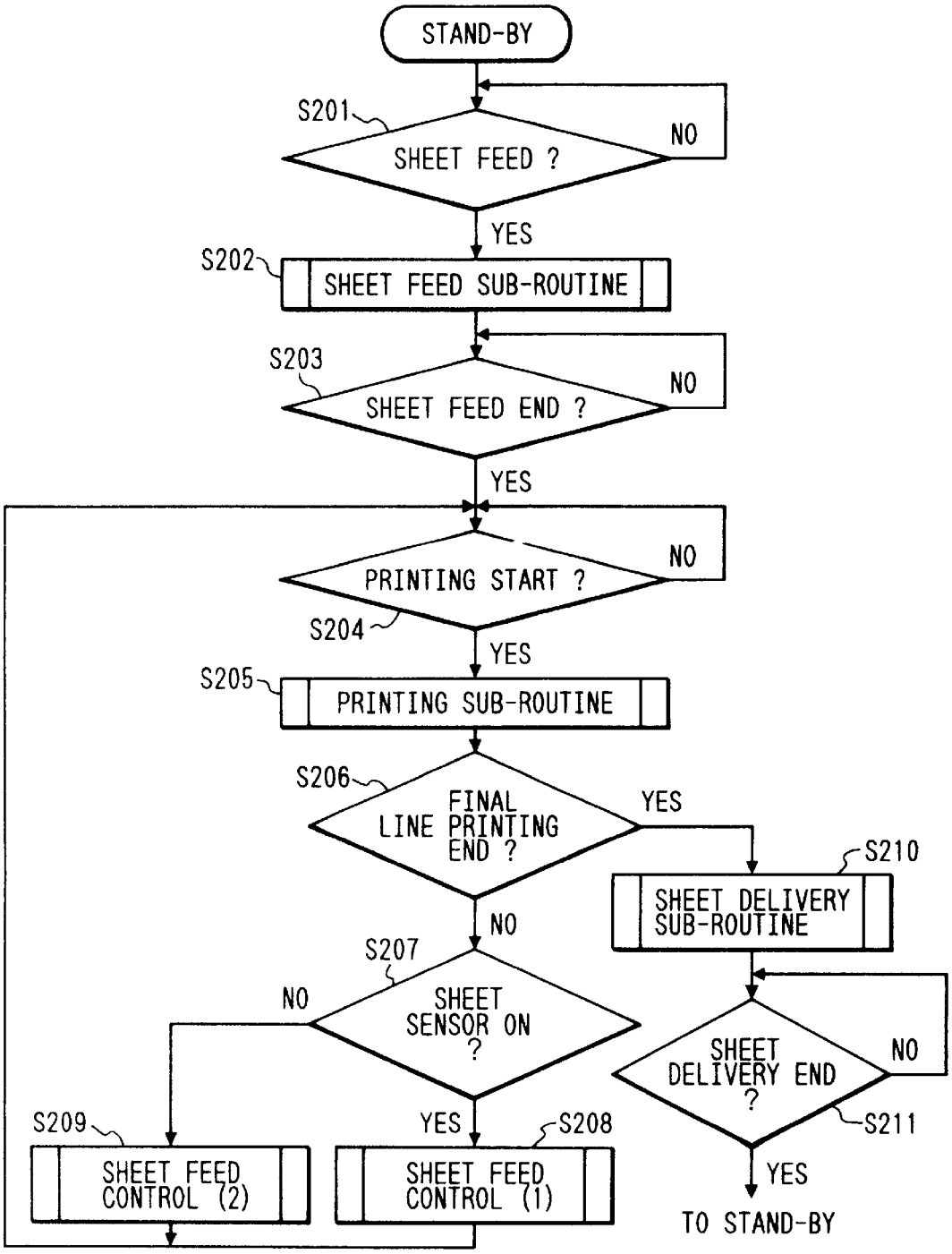
FIG. 28 is a flow chart showing the control sequence by a CPU 106.

FIG. 28 is a flow chart of the control sequence of the CPU 106.

At first a step S201 awaits a sheet feeding instruction, then upon reception thereof, a step S202 transports a sheet to the recording head, and a step S203 awaits the completion of sheet feeding. Then a step S204 awaits a line printing start instruction, and, upon reception thereof, a step S205 executes a print subroutine for driving the head scanning motor. At the end of the printing of a line, a step S206 discriminates whether said line is the last line. If not, a step S207 discriminates whether the sheet sensor is turned on.

(a) If the sheet sensor is on, indicating that the rear-end remaining amount $x\geqq 5.927$, the sequence proceeds to a step S208 for executing the sheet transport control routine (1) for driving the stepping motor with 48 pulses and selecting the correction for print position at 0 dot (no correction).

In this case the displacement y in the print position is:

$0\leqq y\leqq 0.02201$.

Then the sequence returns to the routine for awaitng the start of printing operation.

(b) If the step S207 identifies that the sheet sensor is off, indicating that the rear-end remaining amount $x<5.927$, the sequence proceeds to a step S209 for executing the sheet transport control routine (2) for driving the stepping motor with 47 pulses and correcting the print position by 2 dots (correction value 2).

In this case the aberration y in the print position is:

$-0.02201<y\leqq 0.03725$.

Then the sequence returns to the routine for awaiting the start of next printing operation.

On the other hand, if the step S206 identifies the end of printing of the last line, the sequence proceeds to a step S210 for executing a sheet discharge subroutine. Then a step S211 awaits the completion of sheet discharge, and the sequence returns to the stand-by state for the next sheet feeding.

Thus the relation between the rear-end remaining amount x and the error y assumes a form shown in FIG. 27. It will be apparent, from FIG. 27, that the aberration in the print position is maintained within about d/2, namely within 0.03175 mm.

Figure 30:
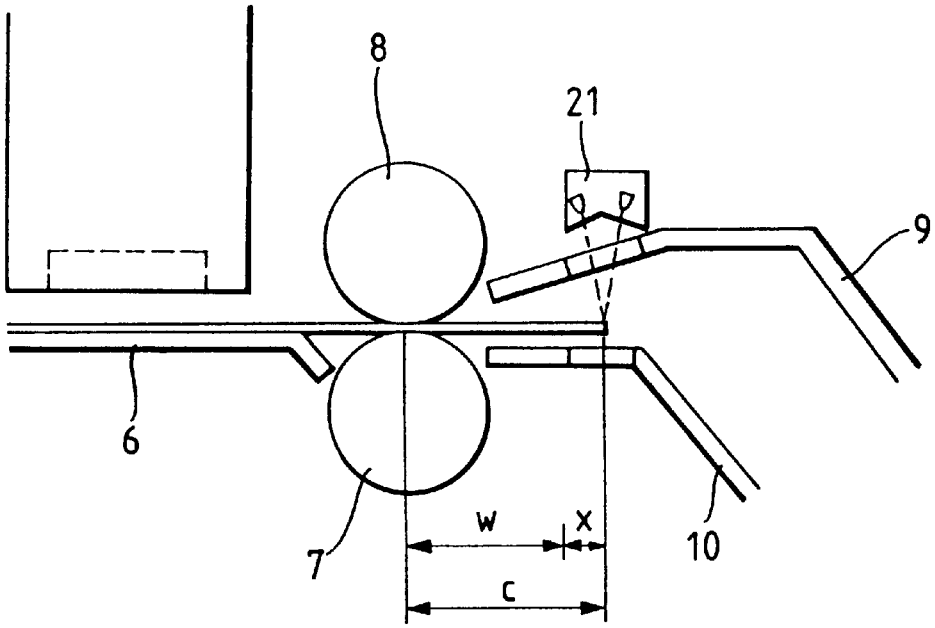
FIG. 30 is a view of a reflective sensor adapted for use in the 3rd embodiment.
Figure 31:
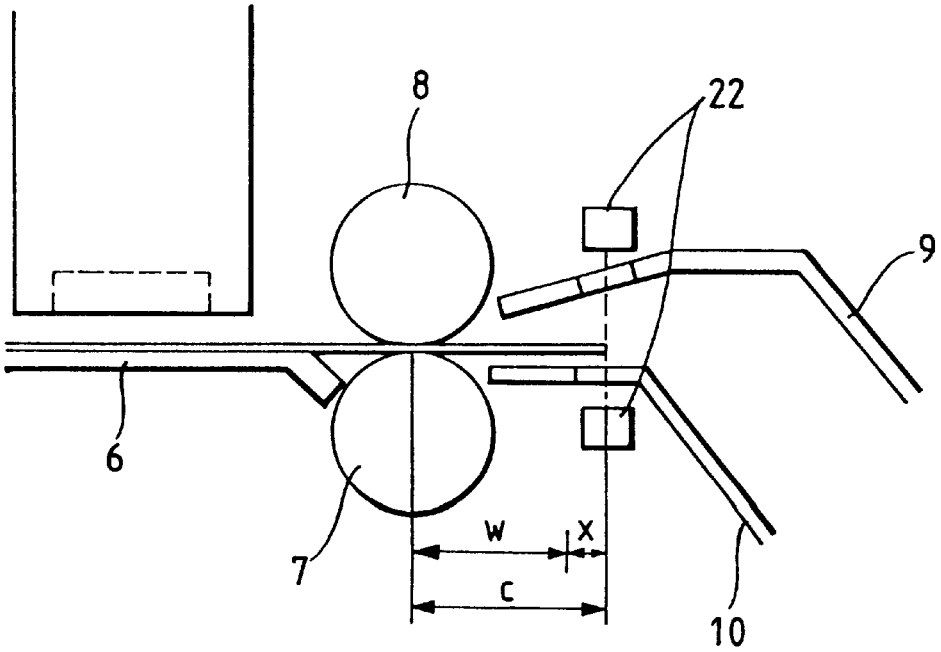
FIG. 31 is a view of a transmission sensor adapted for use in the 3rd embodiment.
Figure 32:
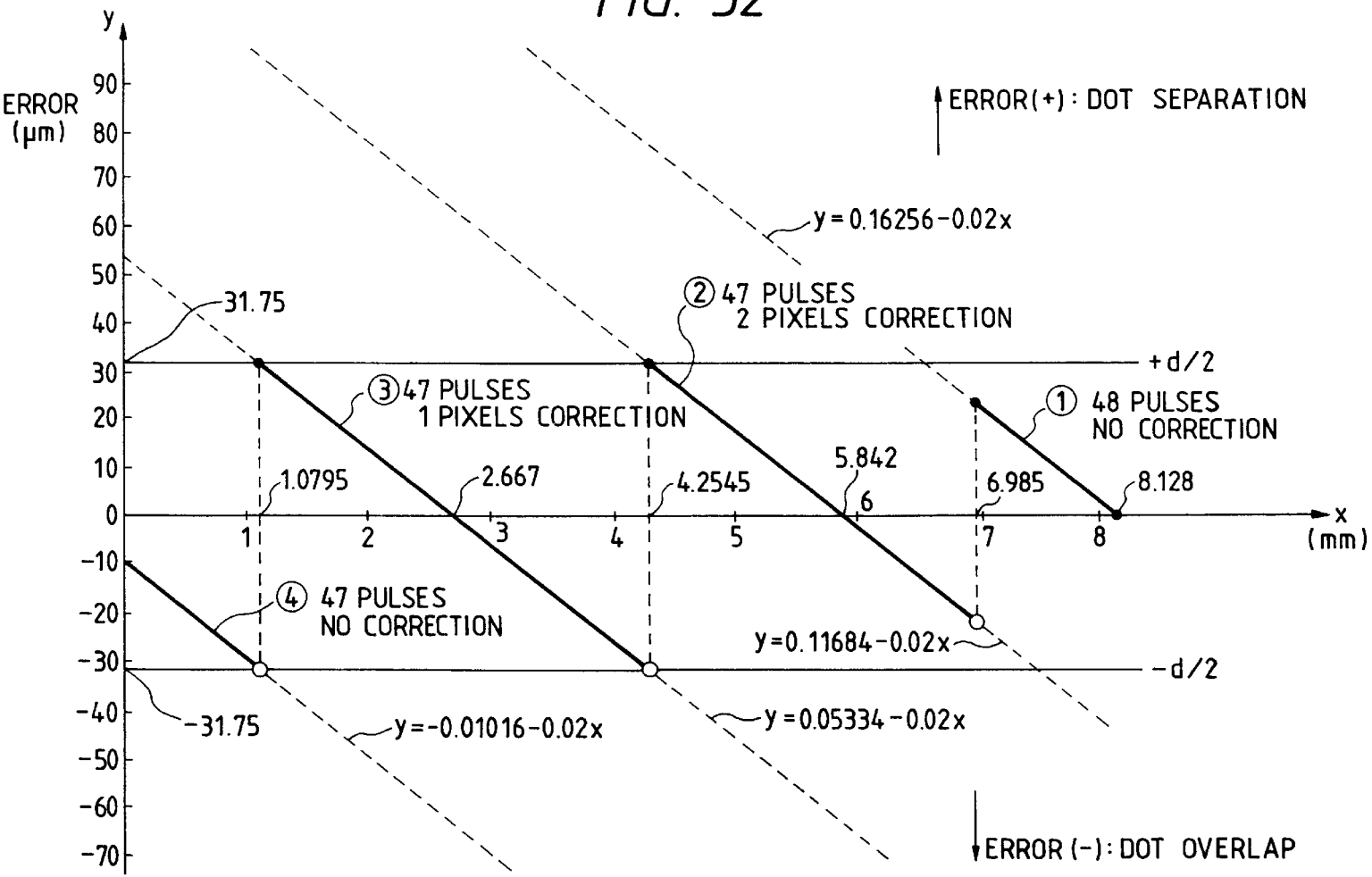
FIG. 32 is a chart showing a rear end process by a pull roller with a transporting amount increased by 2% in the 3rd embodiment.

For detecting the rear end of the sheet, there may be employed a transmissive or reflective sensor as shown in FIGS. 30 or 31.

In the following there will be explained a 3rd embodiment of the present invention, providing three correcting methods within a range of the rear-end remaining amount x from 0 to W.

Figure 29:
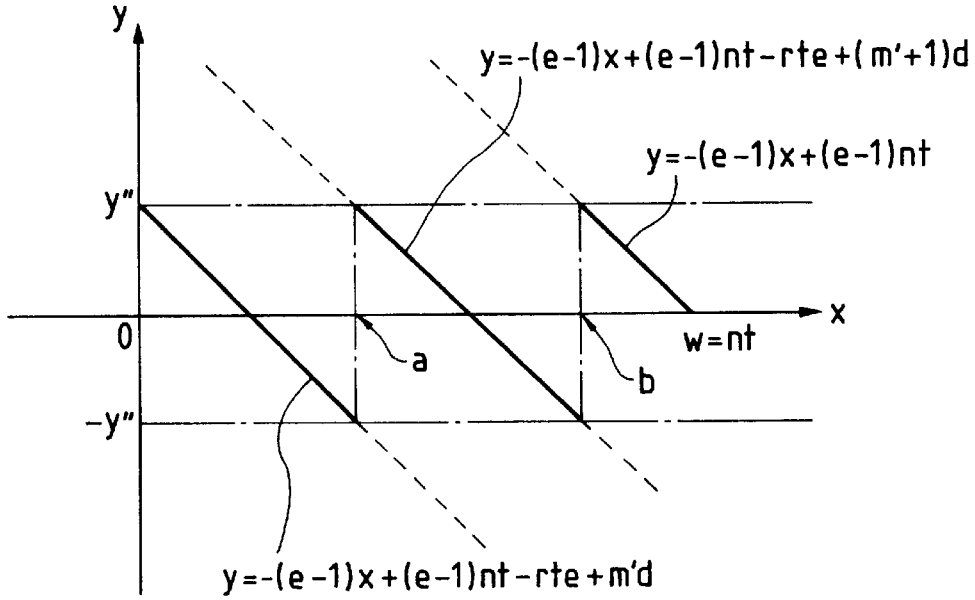
FIG. 29 is a chart showing the relation between the remaining amount x at rear end and the error y in a third embodiment.

In this case, in order to maintain the displacement y within ±y", there is employed a scheme shown in FIG. 29. As shown in FIG. 29, in a range of the rear-end remaining amount x of $0\leqq x\leqq a$, the absolute value of y can be minimized by $y=-(e-1)x+(e-1)nt-rte+m'd$ (correction with r pulses and m' dots). In a range $a\leqq x\leqq b$ said absolute value can be minimized by $y=-(e-1)x+(e-1)nt-rte+(m'+1)d$ (correction with r pulses and (m'+1) dots). In a range $b\leqq x\leqq nt$, the absolute value of y can be minimized by $y=-(e-1)x+(e-1)nt$ (no correction as in the conventional case). Consequently the rear-end remaining amount x has to be judged in three ranges $x\leqq a$, $a\leqq x\leqq b$ and $b\leqq x\leqq nt$, with boundary points a and b.

In this case the rear-end remaining amount cannot be identified in the aforementioned stopped state of the sheet member 2 but has to be identified while the sheet 2 is transported.

In case the sensor arm 19-1 and the transmission sensor 19-2 shown in FIG. 20 are employed as in the 2nd embodiment, when the rear end of the sheet 2 leaves the sensor arm 19-1, the sensor arm 19-1 assumes the broken-lined position in FIG. 20 whereby a signal is obtained from the sensor 19-2. From this point counted are the number of pulses n" for the stepping motor until the sheet 2 is stopped. Taking the position of the sensor arm 10-1 as c, the remaining amount x can be represented by:

$x=c-n''t$ ($n''\leqq n$, $nt<c<2nt$)

$x=c-Nnt-n''t$ ($n''\leqq n$, $2nt\leqq c$, N: natural number).

In this case a condition $c>W$ is necessary, since, if $c<W$, x may become negative depending on the magnitude of n".

Figure 9:
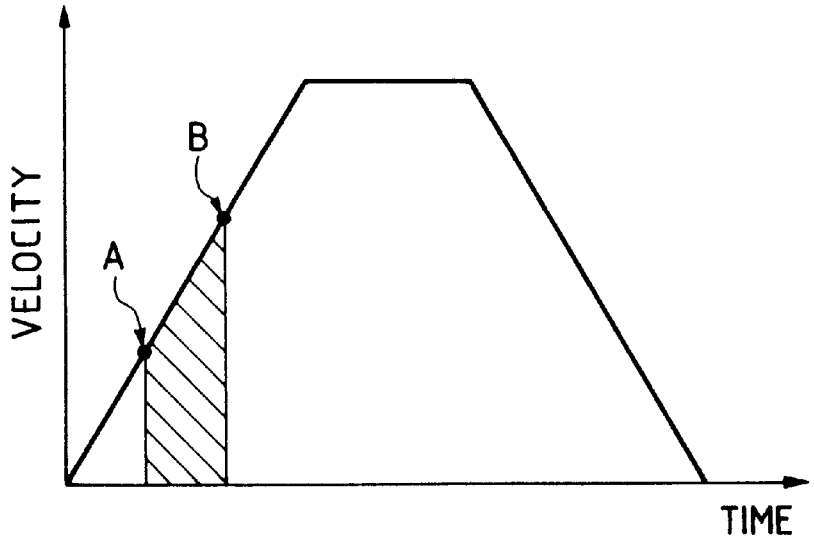
FIG. 9 is a chart showing the transport speed of the sheet member.
Figure 10:
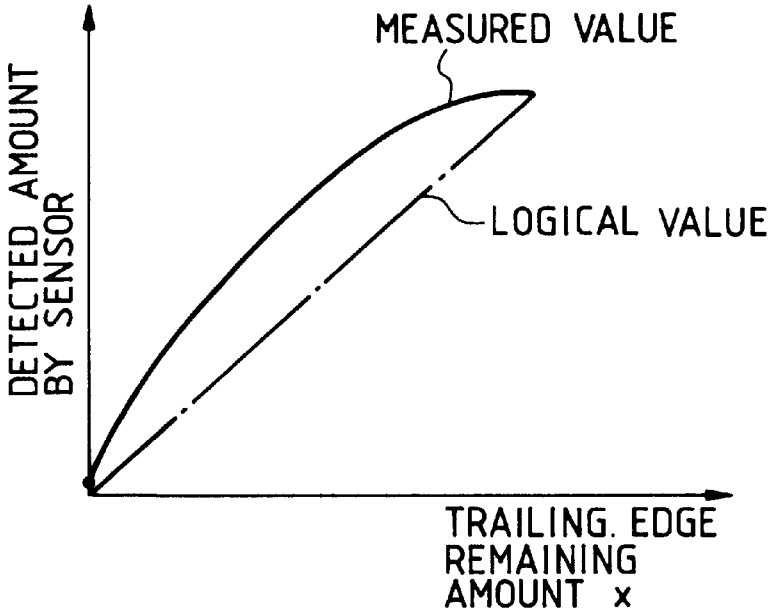
FIG. 10 is a chart showing a theoretical value and a measured value by a rear end sensor.

However, in the transportation of the sheet by the recording width, the sheet has to go through the stages of acceleration, constant speed and deceleration as shown in FIG. 9, and the rotation of the sensor arm 19-1 to the broken-lined position in FIG. 20 requires a certain time (for example the drop of an object for a distance of 0.5 mm by gravity requires about 10 msec.). Therefore, after the rear end of the sheet 2 leaves the sensor arm 19-1 at a point A in FIG. 9, a time (B-A) lapses until the sensor arm 19-1 rotates to the broken-lined position in FIG. 20, thereby generating an error indicated by a hatched area in FIG. 9. Consequently the rear-end remaining amount calculated from the detection signal of the rear end obtained from the sheet sensor 20 becomes significantly different from the actual remaining amount, as shown in FIG. 10.

In the present embodiment, therefore, the error in time is reduced by the use of a reflective sensor shown in FIG. 30 or a transmissive sensor shown in FIG. 31 (response time less than 1 msec.). The position of said sensor has to be so selected as to satisfy a condition $W<c$. The present embodiment employs following parameters:

dot diameter d: 0.0635 mm;

number m of ink discharge openings: 128;

recording width W (=md): 8.128 mm;

pulse number n required for advancement of W: 48 pulses;

transport amount a (=W/n) by lower transport roller per pulse: ca. 0.1693 mm;

ratio e of transport amount by pulling roller to that of transport roller: 1.02, and the error in the print position is maintained with d/2 (=0.03175 mm) by switching the following controls (1)–(4) depending on the rear-end remaining amount x:

(1) if $x\geqq W$ (8.128 mm):

advancement by stepping motor: 48 pulses;

correction for print dot position: 0 dot (no correction).

In this case, the aberration y is 0 mm.

Also if $8.128>x\geqq 6.985$:

advancement by stepping motor: 48 pulses;

correction for print dot position: 0 dot (no correction).

In this case the aberration y is:

$0\leqq y\leqq 0.02286$ mm.

(2) if $6.985>x\geqq 4.2545$:

advancement by stepping motor: 47 pulses;

correction for print dot position: 2 dots.

In this case the aberration y is:

$-0.02286<y\leqq 0.03175$ mm.

(3) if $4.2545>x\geqq 1.0795$:

advancement by stepping motor: 47 pulses;

correction for print dot position: 1 dot.

In this case, the aberration y is:

$-0.03175<y\leqq 0.03175$ mm.

(4) if $1.0795>x\geqq 0$:

advancement by stepping motor: 47 pulses;

correction for print dot position: 0 dot (no correction).

In this case, the aberration y is:

$-0.03175<y\leqq -0.01016$ mm.

Also if $0>x$:

advancement by stepping motor: 47 pulses;

correction for print dot position: 0 dot (no correction).

In this case, the displacement y is: $y=-0.01016$ mm.

Figure 33:
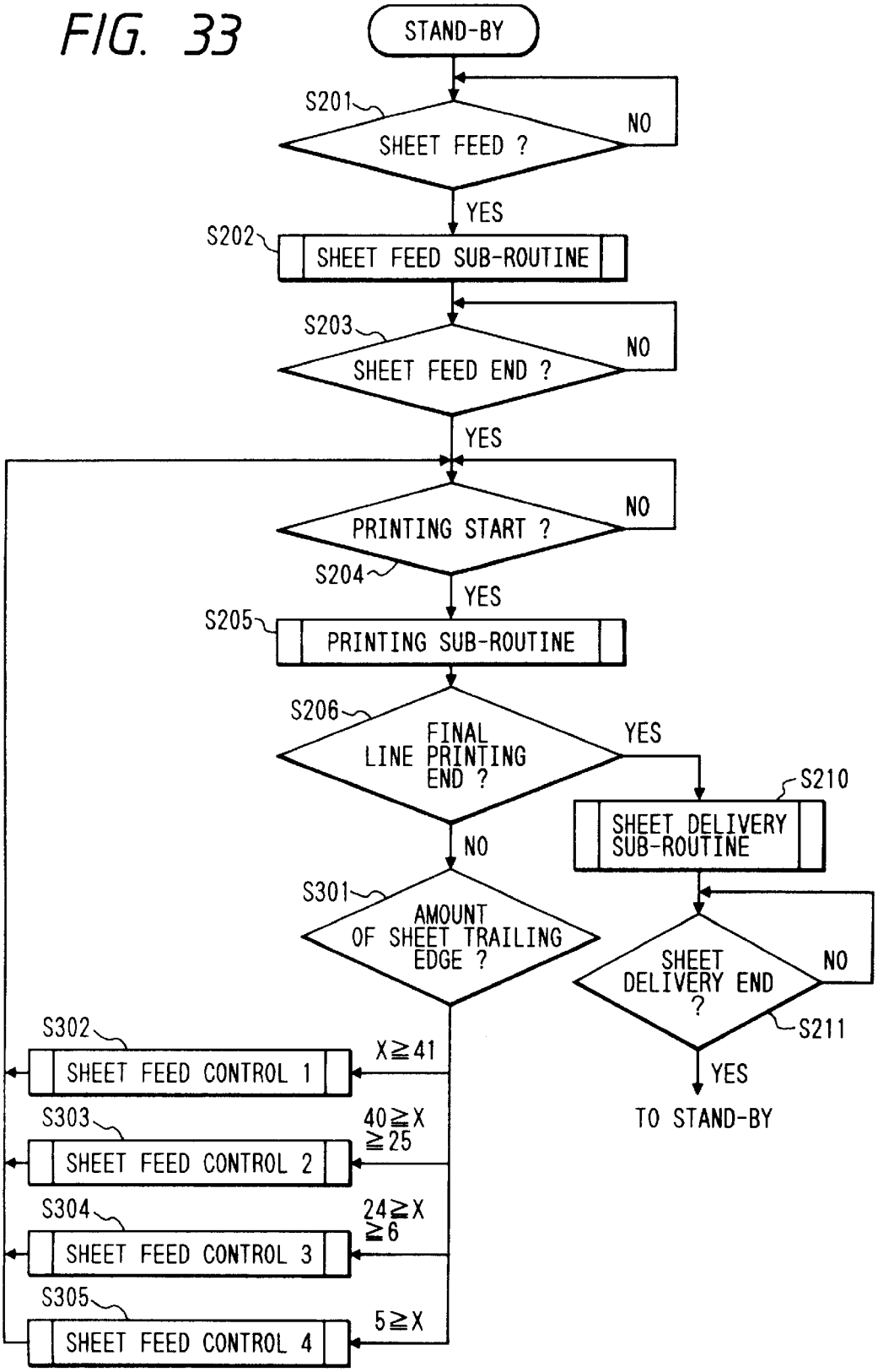
FIG. 33 is a flow chart of the control sequence by a CPU 106 in the 3rd embodiment.

FIG. 33 is a flow chart of the control sequence of a CPU 106 shown in FIG. 21.

Steps S201 to S206 are same as those in the second embodiment, and the step S206 discriminates whether the printing of the last line has been completed. If not completed, the sequence proceeds to a step S301 for identifying whether the rear-end remaining amount x, detected at the immediately preceding sheet advancement, belongs to the range $x\geqq 41$, $40\geqq x\geqq 25$, $24\geqq x\geqq 6$ or $5\geqq x$, and, according to the magnitude of x, one of subroutines for executing the aforementioned controls (1)–(4) is selected in steps S302–S305.

Figure 34:
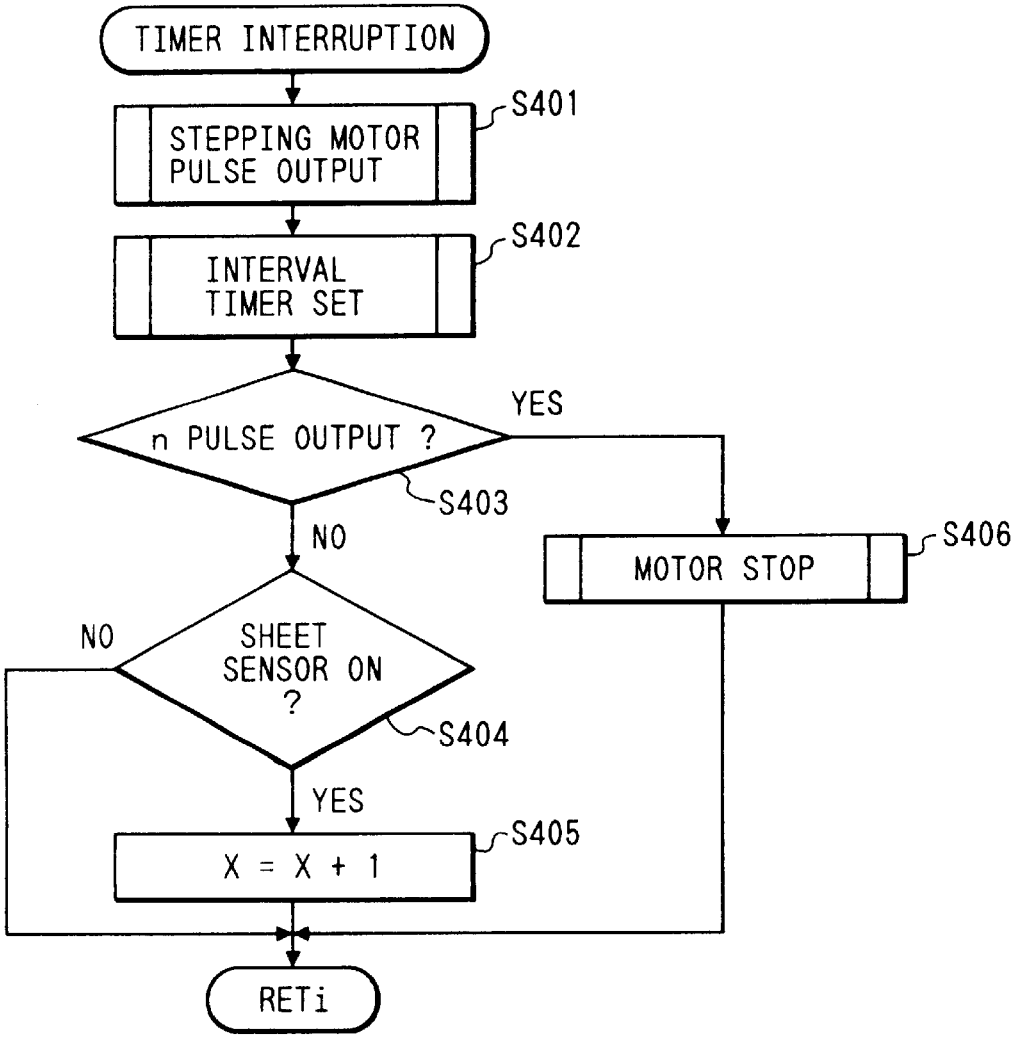
FIG. 34 is a flow chart of the control sequence in a timer interruption routine.

The measurement of said remaining amount is conducted in a timer interruption routine for generating pulses for driving the stepping motor. Said timer interruption routine is shown in FIG. 34.

At first, a step S401 generates a pulse for forming an energizing phase, succeeding to a preceding one, for rotating the stepping motor, and a step S402 sets a time to a timer interruption for the next pulse generation. Then a step S403 discriminates whether n pulses selected in the sheet transport control (48 or 47 pulses in the present embodiment) have been released. If not, a step S404 discriminates whether a sheet is present, based on the output from the sheet sensor, and, if present, a step S405 steps up the count of a remaining amount counter X, and the sheet transport control is terminated. On the other hand, if the sheet is absent, the sheet transport control is immediately terminated.

Thus, if the sheet passes through the sheet sensor in the course of sheet advancement, the count of said remaining amount counter X falls within a range $0\leqq x\leqq 48$. In the present embodiment, one unit of said count corresponds to 0.1693 mm. Therefore:

sheet length for selecting sheet transport control 1: 6.985 mm, $X\approx 41$;

sheet length for selecting sheet transport control 2: 4.2545 mm, $X\approx 25$;

sheet length for selecting sheet transport control 3: 1.0795 mm, $X\approx 6$.

On the other hand, if the step S403 identifies that n pulses have been released, a step S406 stops the motor and the sheet transport control is terminated.

In the present embodiment there are provided three correcting schemes, but there may be similarly utilized four or more correcting schemes.

In the following there will be explained a 4th embodiment.

In the embodiment it is assumed that the supplied sheet 2 has a predetermined size, such as A4 or B5 size, identified for example by the cassette. Naturally the foregoing three embodimetns are applicable to such case, but there will be explained another method.

Figure 35:
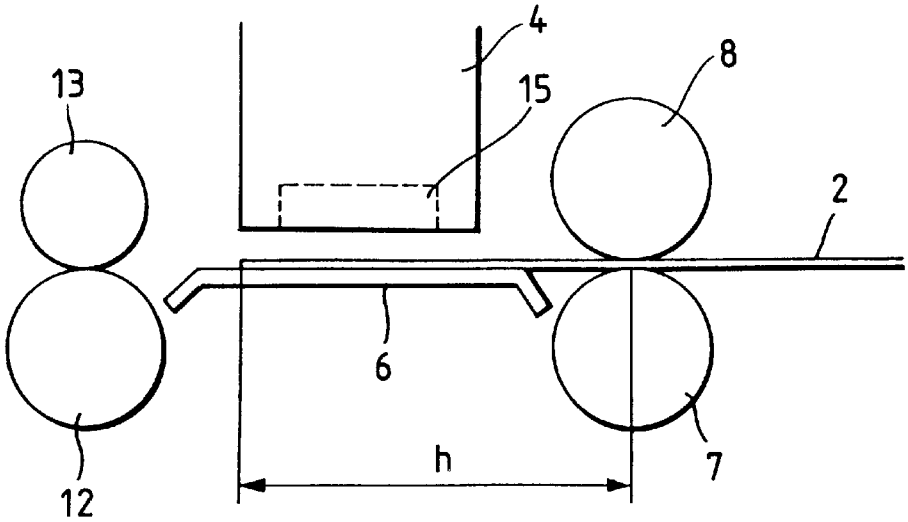
FIG. 35 is a schematic view showing the transportation of the sheet member in a 4th embodiment.

In a transport mechanism described for example in the Japanese Patent Application No. 1-73033 (corresponding to the Japanese Patent Application Laid-open No. 2-249840) and shown in FIG. 35, a sheet 2 is advanced until the leading end thereof slightly protrudes from a lower transport roller 7, and said roller 7 is reversed until said sheet 2 is not pinched by said roller 7. Since the other end of said sheet 2 is supported by a feed roller (not shown) in this state, the leading end of the sheet 2 impinges on the nip between the lower transport roller 7 and an upper transport roller 8. Thus the sheet 2 is advanced after it is aligned along said nip. In this example, the number of rotations of a stepping motor for advancing the sheet 2 can be exactly counted.

Thus, if the sheet 2 is of a predetermined size of which dimension is already known, the rear-end remaining amount x can be represented by:

$$x=l-h-\mathrm{N}nt$$

wherein l is the length of the sheet 2, h is the amount of initial advancement for recording, calculated from the number of rotations of the stepping motor, and N is a positive integer satisfying a relation $0<x<nt$. Thus, if the size of the sheet 2 is known, the rear-end remaining amount x can be easily calculated from the sheet length l, and the correcting scheme can be determined from the thus calculated remaining amount.

Figure 36:
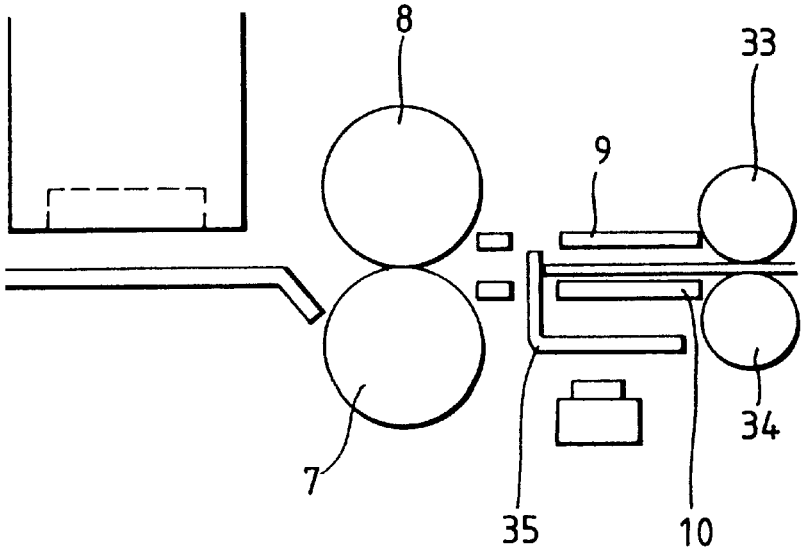
FIG. 36 is a view showing the arrangement of upper and lower slip rollers 33, 34 and a registration shutter 35.

Also if the amount of initial advancement h can be made constant, as in a structure shown in FIG. 36, by maintaining a constant timing for the sheet advancement through the combination of upper and lower slip rollers 33, 34 and a registration shutter 35, correction can be achieved by the size of the sheet 2.

Figure 5:
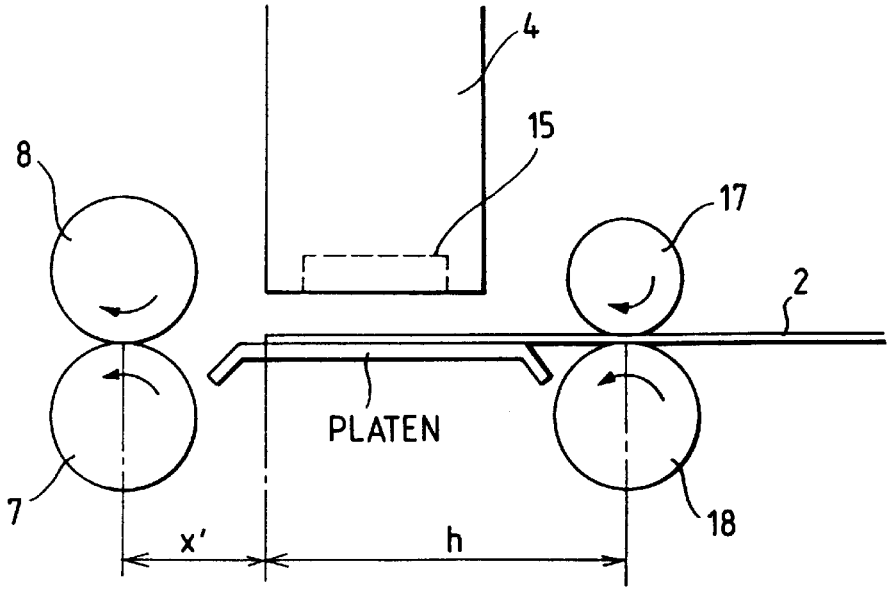
FIGS. 5, 6, 7A and 7B are views showing conventional transportation control for the sheet member.

In the following there will be explained a 5th embodiment of the present invention, in which a sheet 2 is initially transported by upper and lower pulling rollers 17, 18 as shown in FIG. 5.

The transportation of the sheet 2 is conducted in one the following cases (a)–(c), depending on the length h from the leading end of the sheet 2 to the nip of the lower transport roller 7 and the front-end remaining amount x':

(a) if $x'\geqq W$:
the next sheet 2 is also transported by the lower pulling roller 18.

(b) if $0<x'<W$:
the sheet 2 is transported, over a distance x from the front end thereof, by the lower pulling roller 18 and is thereafter transported by the lower transport roller 7;

(c) if $x\leqq 0$:
the sheet 2 is transported by the lower transport roller 7.

The transport amount l' of the sheet with n pulses can be represented as follows, with the ratio f of the transport amount by the lower pulling roller 18 to that of the lower transport roller 7:

(i) if $x\geqq Wf$:
$l'=ntf$;

(ii) if $0<x'<Wf$
$l'=-\{(1-f)/f\}x'+nt$;

(iii) if $x'\leqq 0$:
$l'=nt$.

Figure 37:
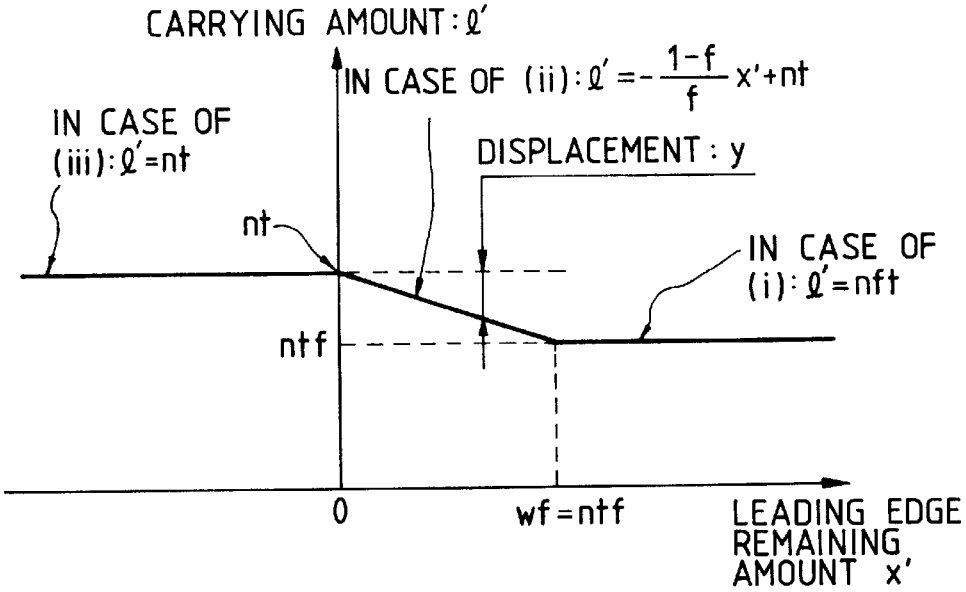
FIG. 37 is a chart showing the relation between the remaining amount at leading end and the transporting amount in a 5th embodiment.

These relations are shown in FIG. 37.

The displacement y' with respect to the recording width W is represented as follows, since $y'=l'-nt$:

(1) if $x'\geqq Wf$:
$y'=nft-nt=(f-1)nt$;

(2) if $0<x'<Wf$:

$$y' = -\{(1-f)/f\}x' + nt - nt$$
$$= -\{(1-f)/f\}x';$$

(3) if $x'\leqq 0$:
$y'=nt-nt=0$.

Since $f<1$, y' becomes smaller than zero in the cases (1) and (2), so that the adjacent lines are recorded with mutual overlapping by y'.

Then, the transport amount l' of the sheet 2 with an increase of r' pulses, namely with (n+r') pulses is:

(a) if $x'\geqq Wf+fr't$:
$l'=(n+r')tf$;

(b) if $0<x'<Wf+r'tf$:
$l'=\{(1-f)/f\}x'+(n+r')t$;

(c) if $x'\leqq 0$:
$l'=(n+r')t$.

Figure 38:
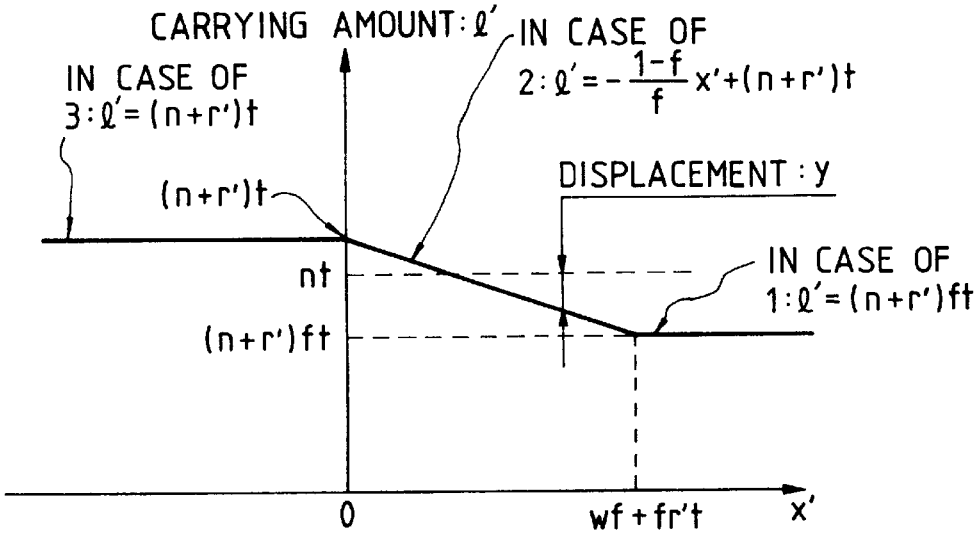
FIG. 38 is a chart showing the relation between the remaining amount at leading end and the transporting amount in the 5th embodiment.

These relations are shown in FIG. 38. In these cases, the displacement y' is represented by:

(a) if $x'\geqq Wf+r'ft$:

$$y' = (n+r')tf - nt$$
$$= nt(f-1) + r'tf;$$

(b) if $0<x'<Wf+r'tf$:

$$y' = -\{(1-f)/f\}x' + (n+r')t - nt$$
$$= -\{(1-f)/f\}x' + r't;$$

(c) if $x'<0$:
$y'=r't$.

Therefore y becomes smaller than zero depending on f and r', so that the transport amount l' of the sheet 2 becomes smaller than the recording width W and the adjacent lines are recorded with mutual overlapping by y'.

By suspending the ink discharge for overlapping m" dots, the recording width becomes $W-m''d=nt-m''d$. Consequently the y' ($=l'-(nt-m''d)$) is represented by:

(a) if $x'\geqq(W+r't)f$:

$$y' = (n+r')tf - (nt - m''d)$$
$$= nt(f-1) + r'tf + m''d;$$

(b) if $0<x'<(W+r't)f$:

$$y' = -\{(1-f)/f\}x' + (n+r')t - (nt - m''d)$$
$$= -\{(1-f)/f\}x' + r't + m''d;$$

(c) $x'\leqq 0$:

$$y' = (n+r')t - (nt - m''d)$$
$$= r't + m''d.$$

Thus, in the case (b), the increased pulse number r' and the overlapping dot number m" may be so selected as to minimize the absolute value of aberration y' as a function of x'.

Also in the cases (a) and (c), the increased pulse number r' and the overlapping dot number m" may be so selected as to minimize the absolute value of displacement y'. These relations are illustrated in FIG. 39.

Figure 39:
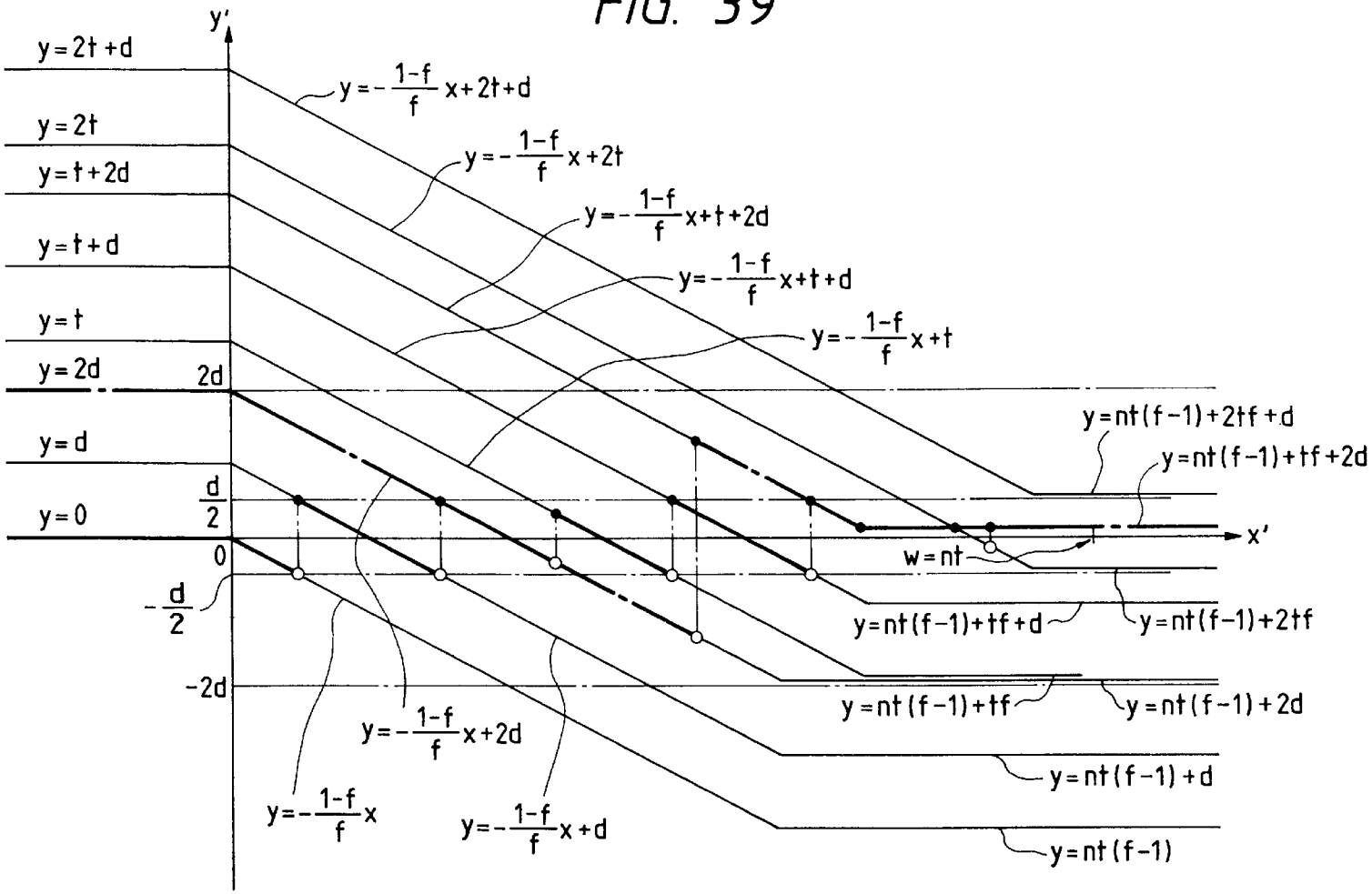
FIG. 39 is a chart showing a front end process.

It will be understood that the absolute value of the displacement y' can be minimized by the relations represented by thick solid lines in FIG. 39. The aberration is maintained within a dot at maximum d (±2/d).

If the tolerance for the aberration y' is selected as ±2d, there may be selected relations represented by thick chain lines, so that the number of correcting schemes can be reduced.

In this manner optimum correction can be achieved by suitably selecting the parameters of equations on the aberration y' and the tolerance thereof.

In the following there will be explained the front-end remaining amount x' with reference to FIG. 5, when the sheet 2 passes through the upper and lower pulling rollers 17, 18 and, after the recording, is transported by the upper and lower transport rollers 7, 8.

Figure 40:
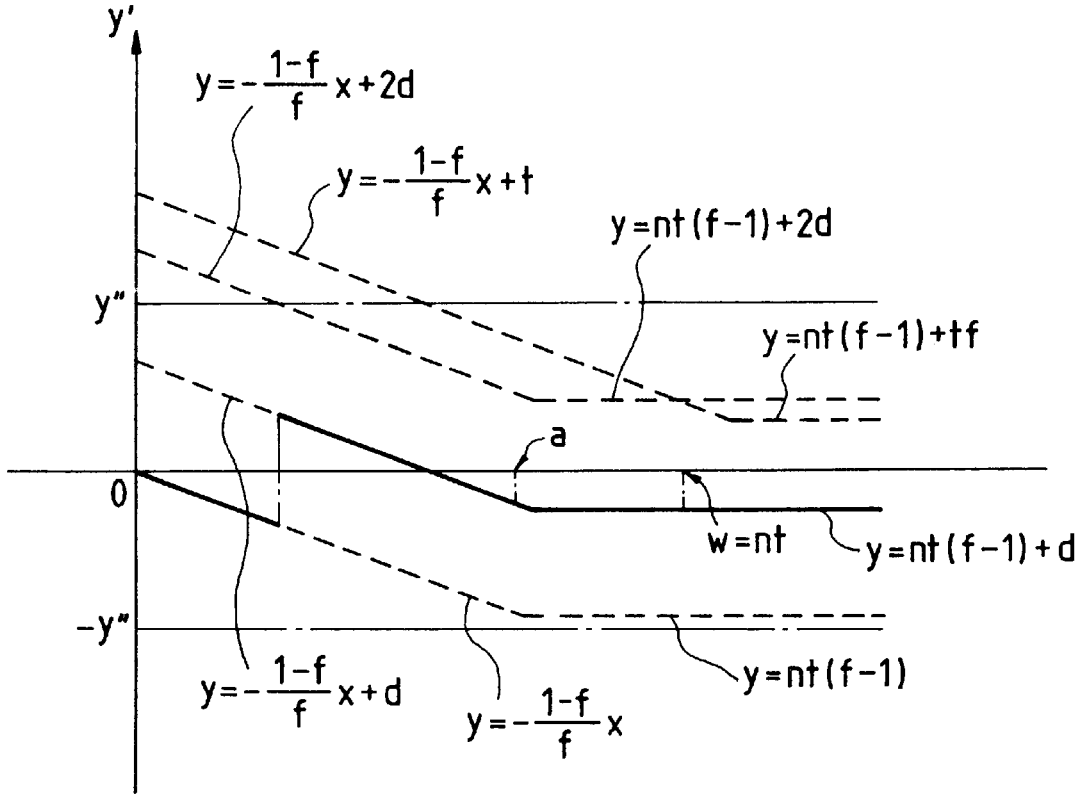
FIG. 40 is a chart showing a correction control.

The amount h of initial advancement for recording can be made constant, for example by the transporting method disclosed in the aforementioned Japanese Patent Application No. 1-73033 (corresponding to the Japanese Patent Application Laid-open No. 2-249840) or a method utilizing a registration shutter. Such constant amount of initial advancement is an essential condition for avoiding fluctuation in the recording position. Also the front-end remaining amount x' becomes constant for a given apparatus, since the position of the upper and lower transport rollers 7, 8 is constant with respect to the initial advancement amount h in a given apparatus. Therefore, based on the conditions of the apparatus, there can be only one correction control. For example, if a control line in FIG. 40 can be adopted with a front-end remaining amount a based on the conditions of the apparatus, the absolute value of y' can be minimized with correction of one dot in the steps until the front end of the sheet 2 enters the nip of the upper and lower transport rollers 7, 8.

However, if the front end position is not constant because of the transport means, there may be employed the aforementioned arm and transmissive sensor, the reflective sensor and/or the transmissive sensor in suitable combination.

As explained in the foregoing, the present invention allows to expand the area of high precision recording by varying the amount of advancement and/or the recording area in case the sheet member is advanced by either of first and second transport means and in case said sheet member is advanced by said first and second transport means in mutual cooperation.

In the following there will be explained a sixth embodiment of the present invention, with reference to FIG. 41, in which the rear end of a sheet is detected precisely with a sensor arm and a transmissive sensor. In FIG. 41, a indicates a basic transport amount of the sheet in a step, and the detection point of the sensor arm 19-1 is distanced by b from said basic transport amount a, in the upstream side in the transport direction of the sheet 2.

Figures 41A, 41B:
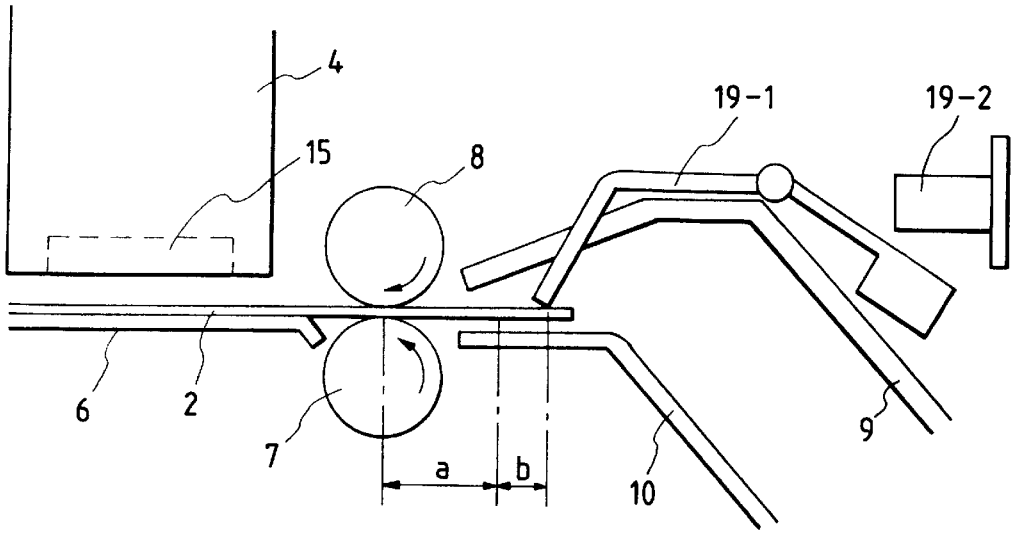
FIGS. 41A and 41B are views of a 6th embodiment.

In the course of successive advancements of the sheet 2 by said basic transport amount a, when the rear end of the sheet 2 is determined to have passed the sensor arm 19-1, at least an amount b of the sheet 2 remains in the upstream side of the transport rollers 7, 8. FIG. 41B shows the number of steps until the photosensor 19-2 detects the rear end of the sheet 2 and the remaining amount at the upstream side of the transport rollers 7, 8 at said detection, for example in case the amount of initial advancement is 20 mm, a basic transport amount a of 8 mm per step, and a sensor arm position b of 4 mm.

The detection with said photosensor may be conducted in the stopped state of the sheet 2 after each transporting step, and does not involve the error resulting from the transport speed, as the detection need not be conducted during sheet transportation as in the conventional method. As shown in FIG. 41B, the number of steps until the detection of rear end of the sheet varies according to the size thereof. On the other hand, said number is specific to each sheet if the amount of transportation at the start of recording, basic transport amount per step and position of the sensor arm are fixed. Therefore, the kind of the sheet can be identified by counting the number of steps until the detection of rear end of the sheet. Similarly the remaining amount at the detection of the rear end is specific to each sheet, so that the amount transportable by the transport rollers 7, 8 after the detection, or the remaining amount of sheet at said detection, is known if the kind of the sheet is identified. Thus the transportation of the sheet 2 after the detection of the rear end thereof can be conducted with an amount adequate for each kind of sheet.

As an example, let us consider A4 size shown in FIG. 41B. The amount transportable by the transport rollers 7, 8 after the sheet rear end detection by the sensor is 5 mm, which is smaller than the recording width of 8 mm. In this case the overlapping of the records can be prevented by advancing the sheet 2 by 5 mm and reducing the ink discharge area of the recording head 4 for obtaining a printing width of 5 mm, so that the recording can be made within an area transportable by the transport rollers 7, 8.

In the present embodiment, the detecting position of the sensor arm is at 12 mm (8+4 mm) from the transport rollers 7, 8. In case of B6 size shown in FIG. 41B, the remaining amount at the detection of the rear end of sheet by the sensor is 10 mm, which is close to 12 mm mentioned above. Thus, if the detecting position of the sensor arm becomes 10 mm or less for example because of fluctuations in the precision of components, the number of steps until the detection of rear end of B6-sized sheet may become 20, with a remaining amount of 2 mm. It will however be understood from FIG. 41B that 20 steps do not correspond to any other size and are closest to 19 steps for the B6 size. Therefore, even when 20 steps are conducted until the detection of rear end of the sheet, it is still possible to identify the sheet size as B6, and to effect advancements of 8 mm 20 times and an advancement of 2 mm at last. Also in any of other sizes, the size identification is possible even in the presence of a fluctuation of ±1 step until the detection of rear end of the sheet since such fluctuated number of steps does not coincide with the number of steps for any other size. More specifically, the number of steps for B4, A4, B5, A5 or any other size, even in the fluctuation of ±1 step, does not coincide with that for any other size.

In case of the B6 size, the remaining amount at the detection by the sensor is 10 mm, so that there will be conducted a basic transportation of 8 mm and a transportation of 2 mm. Thus, at the first transportation, the amount thereof is controlled, and, at the second transportation, the amount thereof and the printing area are controlled. In this manner there may exist a situation in which both the printing area and the transport amount need not be reduced even after the detection of the rear end.

In the following there will be explained a seventh embodiment of the present invention, in which, after the rear end of the sheet 2 passes through the upper and lower transport rollers 7, 8, the transport amount by the pulling rollers 12, 13 and the printing area by the recording head 4 are controlled, in order to expand the printing area at the rear end portion of the sheet 2.

In such case, the sheet 2 can be advanced even after it has passed the transport rollers 7, 8, but the rear end of the sheet 2 may enter the printing area of the recording head 4 depending on the amount of advancement, so that the platen 6 may be smeared with the ink if the recording operation is continued. For preventing such phenomenon, there is required control for reducing the printing area of the recording head 4.

Such control will be explained in the following, with reference to FIGS. 42A and 42B. In said control the transport amount of the sheet and the printing area thereon are to be varied after the rear end of the sheet 2 passes through the transport rollers 7, 8, but, in the following explanation, these amounts are not varied for the purpose of simplification. In practice, certain parameters may be corrected according to the size of the sheet 2. For a printing area W=8 mm, and a rear-end print position l=10 mm, the number of steps until the detection of rear end of the sheet 2 by the sensor arm 19-1 varies according to the sheet size as in the 6th embodiment, and the sheet size can therefore be identified from said number of steps. In this manner there can be identified the number of remaining steps in which 8-mm printing is possible, and the remaining area in which 8-mm printing is not possible. Thus, after the rear end of the sheet 2 is detected by the sensor, the sheet is advanced by the number of said remaining steps, by 8 mm each step, and finally advanced by 8 mm again. At said final advancement, the printing area (number of nozzles used) of the recording head 4 is controlled according to the area, shown in FIG. 42B, in which 8-mm printing is not possible, whereby the printing can be made down to the rear end of the sheet 2.

Figures 42A, 42C:
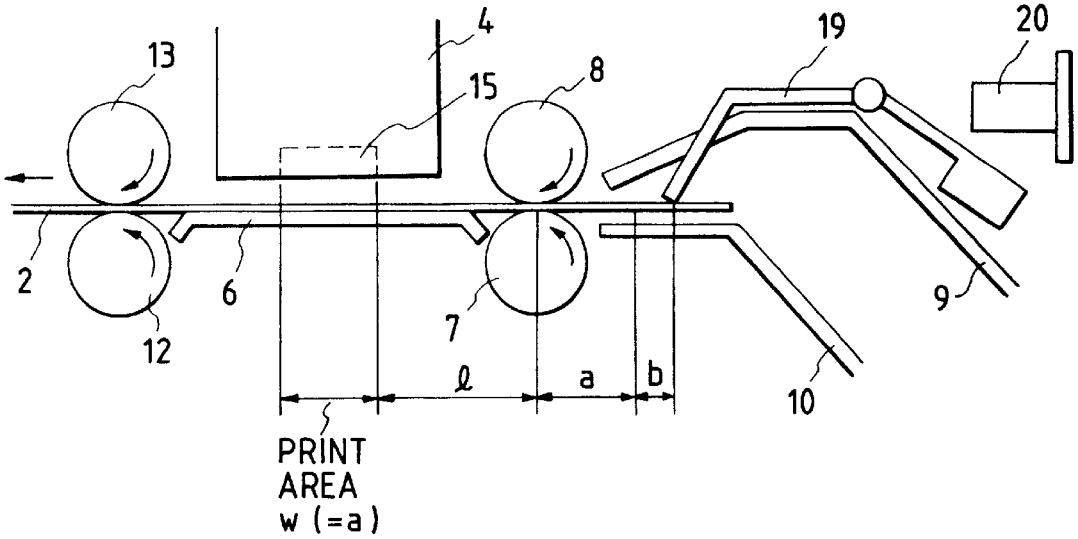

FIG. 42C shows the cases in which a margin is to be provided at the rear end of the sheet. For example for a rear-end margin of 5 mm, the number of remaining steps and the area in which 8-mm printing is not possible are varied, but the control can be conducted in a similar manner.

Figure 8:
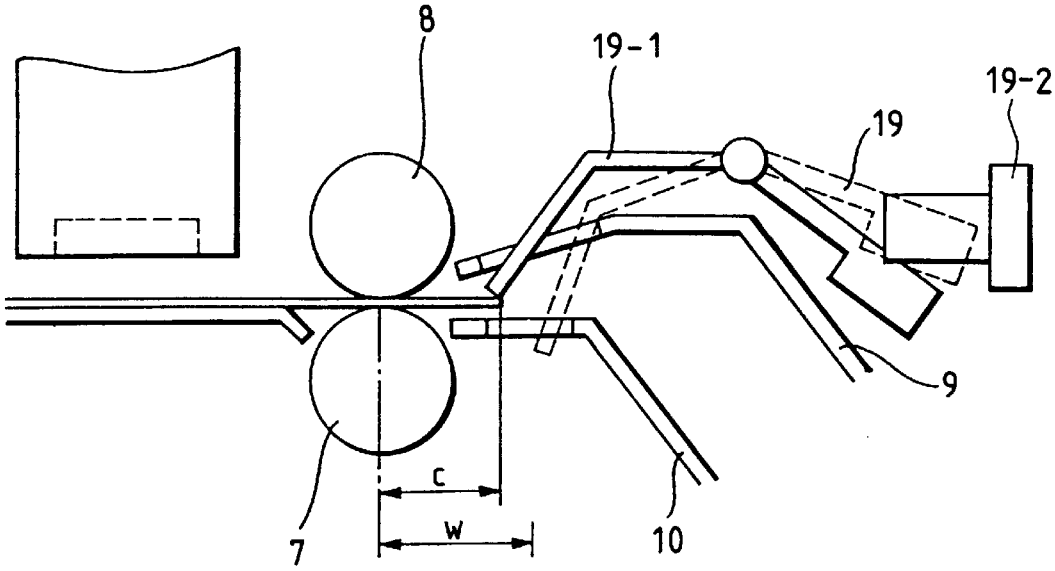
FIG. 8 is a view showing a conventional detection system for the rear end of the sheet member.

As explained in the foregoing, the present invention allows to identify the sheet size by providing a sensor for detecting the rear end of the sheet and counting the number of advancing steps until the rear end of the sheet is detected by said sensor (for example a state 19' of the sensor arm in FIG. 8). It is rendered possible to decrease the margin at the rear end of the sheet by accordingly controlling the amount of advancement of the sheet and the printing area of the recording head.

The present invention brings about excellent effects particularly in a recording head of the bubble jet system, among various ink jet recording systems.

As to its representative constitution and principle, for example, one practiced by the use of the basic principle disclosed in the U.S. Pat. Nos. 4,723,129 and 4,740,796, is preferred. This system is applicable to either of the so-called on-demand type and the continuous type. Particularly, the case of the on-demand type is effective because, by applying at least a driving signal which gives rapid temperature elevation exceeding nucleate boiling corresponding to the recording information on electrothermal converters arranged corresponding to sheets or liquid channels holding liquid (ink), heat energy is generated at said converters to induce film boiling at the heat acting surface of the recording head, and consequently bubbles can be formed in the liquid corresponding one by one to the driving signals. By discharging the liquid through an opening by growth and shrinkage of the bubble, at least one droplet is formed. By making the driving signals into pulse shapes, growth and shrinkage of the bubble can be effected instantly and adequately to accomplish more preferable discharge of the liquid particularly excellent in response characteristics. As the driving signals of such pulse shape, those as disclosed in U.S. Pat. Nos. 4,463,359 and 4,345,262 are suitable. Furthermore, excellent recording can be performed by employment of the conditions described in U.S. Pat. No. 4,313,124 concerning the temperature elevation rate of the above-mentioned heat acting surface.

As to the constitution of the recording head, in addition to the combinations of discharge orifice, liquid channel, electrothermal converters (linear liquid channel or right angle liquid channel) as disclosed in the above-mentioned patents, the constitution by the use of U.S. Pat. No. 4,558,333 or 4,459,600 disclosing the constitution having the heat acting portion arranged in the flexed region is also included in the present invention. In addition, in the present invention, there may be effectively applied the constitution as disclosed in Japanese Patent Laid-open Application No. 59-123670 which discloses a constitution using a slit common to plural electrothermal converters as the discharging portion therefor or Japanese Patent Laid-open Application No. 59-138461 which discloses a constitution having an opening for absorbing pressure waves of heat energy, communicating with the discharging portion.

Furthermore, as the recording head of the full line type having a width corresponding to the maximum recordable width of the recording medium, there may be employed either the constitution which satisfies its length by combination of plural recording heads as disclosed in the above-mentioned specifications or the constitution formed by an integral recording head, and the present invention can exhibit the above-mentioned effects effectively.

In addition, the present invention is effective for a recording head of freely exchangeable chip type which enables electrical connection to the main device or supply of ink therefrom upon being mounted on said main device, or for a recording head of cartridge type, integrally including an ink tank.

Also, addition of restoration means, auxiliary means etc. for the recording head is preferable, because the effects of the present invention can be further stabilized. Specific examples of such means include capping means, cleaning means, pressurization or aspiration means, heating or preheating means for the recording head, and these may be employed in suitable combinations. It is also effective to effect preliminary recording mode, which performs ink discharge not intended for recording, for achieving stable recording operation.

Furthermore, as the recording mode of the recording device, the present invention is extremely effective not only for the recording of a primary color such as black, but also for the recording with one of plural different colors or with full colors by color mixing, regardless whether there is employed an integrally constructed head or plural heads in combination.

Furthermore, the ink jet recording apparatus of the present invention may be employed, not only as an image output terminal for an information processing apparatus such as a computer, but also as a copying machine in combination with an image reader, or a facsimile apparatus with transmitting and receiving functions.

What is claimed is:

1. A serial recording apparatus for forming a record section of a predetermined width or less with record means on a sheet member, said apparatus comprising:

first and second transport means provided respectively at upstream and downstream sides of a transport path, for transporting the sheet member by repeating a step transportation of the sheet member by the predetermined width, wherein when said first and second transport means cooperate at the upstream and downstream sides to transport the sheet member, a transport amount of the second transport means at the downstream side is set so as to be greater than a transport amount of the first transport means at the upstream side to thereby apply tension to the sheet member;

detection means for detecting a rear end of the sheet member;

counter means for counting the number of step transportations for the sheet member until detection of the rear end of the sheet member by said detection means;

determining means for determining the size of the sheet member based on the number of step transportations counted by said counter means; and control means for varying at least one of the transportation amount of the sheet member per print by said transport means at the downstream side and the size of the recording area on said sheet member, after detection of the rear end of the sheet member by said detection means and transportation of the sheet member by only said transport means at the downstream side, in accordance with the determined size of the sheet member, and wherein said control means controls at least one of the recording area and the amounts of transportation so as to maintain uniformity of spacing without overlap between a recording section on one part of the sheet member recorded during transportation by said first and second transport means and a recording section on another part of the sheet member recorded during transportation by only said transport means at the downstream side.

2. An apparatus according to claim 1, wherein the record means is adapted to induce film boiling in ink by means of thermal energy and to discharge ink by growth of a bubble generated by the film boiling.

3. A serial recording apparatus comprising:

record means for recording an image on a sheet member;

first and second sheet transport means respectively provided on both sides of said record means; and control means for controlling the amounts of transportation of said first and second sheet transport means and a recording area of said record means in a first state where the sheet member is transported by one of said first and second sheet transport means and in a second state where the sheet member is transported by said first and second sheet transport means in mutual cooperation, wherein in the second state said control means controls the amounts of transportation of said first and second sheet transport means to be different from one another so as to apply tension to the sheet member, and in the first state said control means controls the amounts of transportation so as to be substantially equal to one another, and said control means also varies the recording area of said record means between the first state and the second state in accordance with a difference between the transport amounts for the sheet member of said first and second sheet transport means, and wherein said control means controls at least one of the recording area and the amounts of transportation so as to maintain uniformity of spacing without overlap between a recording section on one part of the sheet member recorded in the second state and a recording section on another part of the sheet member recorded in the first state.

4. An apparatus according to claim 3, wherein said record means is adapted to induce film boiling in ink by means of thermal energy and to discharge ink by growth of a bubble generated by the film boiling.

5. A serial recording apparatus comprising:

record means for recording an image on a sheet member;

first and second sheet transport means respectively provided on both sides of said record means; and transport amount control means for controlling amounts of transportation of said first and second sheet transport means in a first state where the sheet member is transported by one of said first and second transport means and in a second state where the sheet member is transported by said first and second sheet transport means in mutual cooperation, wherein in the second state, said transport amount control means controls the amounts of transportation of said first and second sheet transport means to be different from one another so as to apply tension to the sheet member, and in the first state, said transport amount control means controls the amounts of transportation so as to be substantially equal to one another, and wherein said control means controls the transport amounts so as to maintain uniformity of spacing without overlap between a recording section on one part of the sheet member recorded in the second state and a recording section on another part of the sheet member recorded in the first state.

6. An apparatus according to claim 5, wherein said first sheet transport means includes a first pair of rollers while said second sheet transport means includes a second pair of rollers, wherein the transport amount control means is adapted, when the sheet member is transported from said first paired rollers to said second paired rollers, to vary the amount of transportation by said second paired rollers immediately after the rear end of the sheet member leaves said first paired rollers.

7. An apparatus according to claim 6, further comprising detection means for detecting the remaining amount at the rear end of the sheet member until the rear end of the sheet member leaves the first paired rollers, wherein the transport amount control means is adapted to vary the amount of transportation by the second paired rollers according to the rear-end remaining amount detected by said detection means.

8. An apparatus according to claim 6, wherein said transport amount control means is adapted, when the sheet member is transported from said first paired rollers toward said second paired rollers, to vary the amount of transportation by said first paired rollers immediately after the front end of the sheet member is pinched by said second paired rollers.

9. An apparatus according to claim 5, wherein said record means includes plural discharge openings and is adapted to effect recording by discharging ink from said discharge openings toward the sheet member.

10. A serial recording method for forming a record section of a predetermined width or less with record means on a sheet member, said method comprising the steps of:

providing first and second transport means respectively at upstream and downstream sides of a transport path, for transporting the sheet member by repeating a step transportation of the sheet member by the predetermined width, wherein when the first and second transport means cooperate at the upstream and downstream sides to transport the sheet member, a transport amount of the second transport means at the downstream side is set so as to be greater than a transport amount of the first transport means at the upstream side to thereby apply tension to the sheet member;

detecting a rear end of the sheet member;

counting the number of step transportations for the sheet member until detection of the rear end of the sheet member in said detecting step;

determining the size of the sheet member based on the number of step transportations counted in said counting step; and controlling by varying at least one of the transportation amount of the sheet member per print by the transport means at the downstream side and the size of the recording area on the sheet member, after detection of the rear end of the sheet member in said detecting step and transportation of the sheet member by only the transport means at the downstream side, in accordance with the determined size of the sheet member, and wherein said controlling step controls at least one of the recording area and the amounts of transportation so as to maintain uniformity of spacing without overlap between a recording section on one part of the sheet member recorded during transportation by the first and second transport means and a recording section on another part of the sheet member recorded during transportation by only the transport means at the downstream side.

11. A serial recording method comprising the steps of:

providing record means for recording an image on a sheet member;

providing first and second sheet transport means respectively on both sides of the record means; and controlling the amounts of transportation of the first and second sheet transport means and a recording area of the record means in a first state where the sheet member is transported by one of the first and second sheet transport means and in a second state where the sheet member is transported by the first and second sheet transport means in mutual cooperation, wherein in the second state said controlling step controls the amounts of transportation of the first and second sheet transport means to be different from one another so as to apply tension to the sheet member, and in the first state said controlling step controls the amounts of transportation so as to be substantially equal to one another, and said controlling step also varies the recording area of the record means between the first state and the second state in accordance with a difference between the transport amounts for the sheet member of the first and second sheet transport means, and wherein said controlling step controls at least one of the recording area and the amounts of transportation so as to maintain uniformity of spacing without overlap between a recording section on one part of the sheet member recorded in the second state and a recording section on another part of the sheet member recorded in the first state.

12. A serial recording method comprising the steps of:

providing record means for recording an image on a sheet member;

providing first and second sheet transport means respectively on both sides of the record means; and controlling amounts of transportation of the first and second sheet transport means in a first state where the sheet member is transported by one of the first and second transport means and in a second state where the sheet member is transported by the first and second sheet transport means in mutual cooperation, wherein in the second state, said controlling step controls the amounts of transportation of the first and second sheet transport means to be different from one another so as to apply tension to the sheet member, and in the first state, said controlling step controls the amounts of transportation so as to be substantially equal to one another, and wherein said controlling step controls the transport amounts so as to maintain uniformity of spacing without overlap between a recording section on one part of the sheet member recorded in the second state and a recording section on another part of the sheet member recorded in the first state.

13. A serial recording apparatus comprising:

record means for recording an image on a recording medium according to recording information, said record means forming a recording section of a predetermined width or less in accordance with one scan;

two recording medium transport means provided respectively at upstream and downstream sides of a transport path, for transporting the recording medium, wherein when said two transport means cooperate at the upstream and downstream sides to transport the recording medium, a transport amount of the transport means at the downstream side is set so as to be greater than a transport amount of the transport means at the upstream side to thereby apply tension to the recording medium; and record control means for effecting the recording on the recording medium by changing the recording section in accordance with a difference between the transport amounts for the recording medium of said two transport means, when the recording medium is released from said transport means of the upstream side and is transported by said transport means of the downstream side only, wherein said control means controls the recording section so as to maintain uniformity of spacing without overlap between a recording section on one part of the recording medium recorded during transportation by said two recording medium transport means and a recording section on another part of the recording medium recorded during transportation by only said recording medium transport means at the downstream side.

14. An apparatus according to claim 13, wherein said control means changes the recording section in accordance with a minimum recording unit.

15. An apparatus according to claim 13, wherein said record control means is adapted to control the recording in a rear portion of the recording medium, in each predetermined recording unit of said record means.

16. An apparatus according to claim 13, further comprising transport amount control means for controlling the amount of transportation of the recording medium by said transport means within a line pitch.

17. An apparatus according to claim 13, wherein said record means includes plural discharge openings and is adapted to effect recording by discharging ink from said discharge openings toward the recording medium.

18. An apparatus according to claim 17, wherein said record means includes an element for generating thermal energy for inducing film boiling in the ink, as energy to be utilized for ink discharge.

19. A serial recording method comprising the steps of:

providing record means for recording an image on a recording medium according to recording information, the record means forming a recording section of a predetermined width or less in accordance with one scan;

providing two recording medium transport means respectively at upstream and downstream sides of a transport path, for transporting the recording medium, wherein when the two transport means cooperate at the upstream and downstream sides to transport the recording medium, a transport amount of the transport means at the downstream side is set so as to be greater than a transport amount of the transport means at the upstream side to thereby apply tension to the recording medium; and controlling recording on the recording medium by changing the recording section in accordance with a difference between the transport amounts for the recording medium of the two transport means, when the recording medium is released from the transport means of the upstream side and is transported by the transport means of the downstream side only, wherein said controlling step controls the recording section so as to maintain uniformity of spacing without overlap between a recording section on one part of the recording medium recorded during transportation by the two recording medium transport means and a recording section on another part of the recording medium recorded during transportation by only the recording medium transport means at the downstream side.

20. A serial recording apparatus comprising:

record means for recording an image on a recording medium according to recording information, said record means forming a recording section of a predetermined width or less in accordance with one scan;

two recording medium transport means provided respectively at an upstream side and a downstream side of a transport path, for transporting the recording medium, wherein when said two transport means cooperate at the upstream and downstream sides to transport the recording medium, a transport amount of the transport means at the downstream side is set so as to be greater than a transport amount of the transport means at the upstream side to thereby apply tension to the recording medium; and record control means for effecting the recording on the recording medium by changing the recording section in accordance with a difference between the transport amounts for the recording medium of said two transport means, when the recording medium is not engaged by said transport means of the downstream side and is transported by said transport means of the upstream side only, wherein said control means controls the recording section so as to maintain uniformity of spacing without overlap between a recording section on one part of the recording medium recorded during transportation by said two recording medium transport means and a recording section on another part of the recording medium recorded during transportation by only said recording medium transport means at the upstream side.

21. An apparatus according to claim 20, wherein said control means changes the recording section in accordance with a minimum recording unit.

22. An apparatus according to claim 20, wherein said record control means is adapted to control the recording in a front portion of the recording medium, in each predetermined recording unit of said record means.

23. An apparatus according to claim 20, further comprising transport amount control means for controlling the amount of transportation of the recording medium by said transport means within a line pitch.

24. An apparatus according to claim 20, wherein said record means includes plural discharge openings and is adapted to effect recording by discharging ink from said discharge openings toward the recording medium.

25. An apparatus according to claim 24, wherein said record means includes an element for generating thermal energy for inducing film boiling in the ink, as energy to be utilized for the ink discharge.

26. A serial recording method comprising the steps of:

providing record means for recording an image on a recording medium according to recording information, the record means forming a recording section of a predetermined width or less in accordance with one scan;

providing two recording medium transport means respectively at an upstream side and a downstream side of a transport path, for transporting the recording medium, wherein when the two transport means cooperate at the upstream and downstream sides to transport the recording medium, a transport amount of the transport means at the downstream side is set so as to be greater than a transport amount of the transport means at the upstream side to thereby apply tension to the recording medium; and controlling recording on the recording medium by changing the recording section in accordance with a difference between the transport amounts for the recording medium of the two transport means, when the recording medium is not engaged by the transport means of the downstream side and is transported by the transport means of the upstream side only, wherein said controlling step controls the recording section so as to maintain uniformity of spacing without overlap between a recording section on one part of the recording medium recorded during transportation by the two recording medium transport means and a recording section on another part of the recording medium recorded during transportation by only the recording medium transport means at the upstream side.

27. A serial recording apparatus comprising:

record means for recording an image on a sheet member;

first and second sheet transport means respectively provided on both sides of said record means and having mutually different amounts of transportation; and recording area control means for varying a recording area of said record means in a first state where the sheet member is transported by one of said first and second sheet transport means and in a second state where the sheet member is transported by said first and second sheet transport means in mutual cooperation, wherein said recording area control means varies the recording area of said record means between the first state and the second state in accordance with a difference between the amounts of transportation of the sheet member of said first and second sheet transport means, and wherein said control means controls the recording area so as to maintain uniformity of spacing without overlap between a recording section on one part of the sheet member recorded in the second state and a recording section on another part of the sheet member recorded in the first state.

28. An apparatus according to claim 27, wherein said first sheet transport means includes a first pair of rollers while said second sheet transport means includes a second pair of rollers, and said recording area control means is adapted, when the sheet member is transported from said first paired rollers toward said second paired rollers, to vary the size of the recording area immediately after the rear end of the sheet member leaves said first paired rollers.

29. An apparatus according to claim 28, further comprising detection means for detecting the remaining amount at the rear end of the sheet member until the rear end of the sheet member leaves said first paired rollers, wherein said recording area control means is adapted to vary the size of the recording area according to the rear-end remaining amount detected by said detection means.

30. An apparatus according to claim 28, wherein said recording area control means is adapted, when the sheet member is transported from said first paired rollers toward said second paired rollers, to vary the size of the recording area immediately after the front end of the sheet member is pinched by said second paired rollers.

31. An apparatus according to claim 27, wherein said record means is adapted to induce film boiling in ink by means of thermal energy and to discharge ink by growth of a bubble generated by the film boiling.

32. A serial recording method comprising the steps of:

providing record means for recording an image on a sheet member;

providing first and second sheet transport means respectively on both sides of the record means and having mutually different amounts of transportation; and controlling by varying a recording area of the record means in a first state where the sheet member is transported by one of the first and second sheet transport means and in a second state where the sheet member is transported by the first and second sheet transport means in mutual cooperation, wherein said controlling step varies the recording area of the record means between the first state and the second state in accordance with a difference between the amounts of transportation of the sheet member of the first and second sheet transport means, and wherein said controlling step controls the recording area so as to maintain uniformity of spacing without overlap between a recording section on one part of the sheet member recorded in the second state and a recording section on another part of the sheet member recorded in the first state.

33. An image recording apparatus for recording images of a predetermined width or less on a recording medium by scanning a recording head, said apparatus comprising:

first transport means for transporting the recording medium for each scan of the recording head, a transport amount by said first transport means corresponding to the predetermined width of the images;

second transport means provided downstream of said first transport means, for transporting the recording medium for each scan of the recording head, when said first and second transport means transport the recording medium in mutual cooperation; and control means for controlling an amount of transportation of said first and second transport means in a first state where the recording medium is transported by one of said first and second transport means and in a second state where the recording medium is transported by said first and second transport means in mutual cooperation, wherein in the second state, said control means controls a transport amount by said second transport means to be greater than the transport amount by said first transport means, so as to apply tension to the recording medium, and in the first state, said control means reduces the transport amount of one of said first and second transport means, and wherein said control means controls the transport amounts so as to maintain uniformity of spacing without overlap between a recording section on one part of the recording medium recorded in the second state and a recording section on another part of the recording medium recorded in the first state.

34. An apparatus according to claim 33, wherein said control means includes detection means for detecting a remaining amount at a rear end of the recording medium until the rear end of the recording medium is transported beyond said first transport means, and said control means reduces the transport amount by said second transport means in accordance with the remaining amount detected by said detection means.

35. An apparatus according to claim 33, wherein each of said first and second transport means includes a pair of rollers for pinching the recording medium.

36. An apparatus according to claim 35, wherein said pairs of rollers are driven and rotated by stepping motor means.

37. An apparatus according to claim 36, wherein said control means reduces pulses supplied to said stepping motor means for driving said second transport means.

38. An apparatus according to claim 33, wherein said control means changes a record section of the recording head when only said second transport means transports the recording medium.

39. An apparatus according to claim 38, wherein said control means includes detection means for detecting a remaining amount at a rear end of the recording medium until the rear end of the recording medium is transported beyond said first transport means, and said control means reduces the record section of the recording head in accordance with the remaining amount detected by said detection means.

40. An image recording method for recording images of a predetermined width or less on a recording medium by scanning a recording head, said method comprising the steps of:

providing first transport means for transporting the recording medium for each scan of the recording head, a transport amount by the first transport means corresponding to the predetermined width of the images;

providing second transport means downstream of the first transport means, for transporting the recording medium for each scan of the recording head, when the first and second transport means transport the recording medium in mutual cooperation; and controlling an amount of transportation of the first and second transport means in a first state where the recording medium is transported by one of the first and second transport means and in a second state where the recording medium is transported by the first and second transport means in mutual cooperation, wherein in the second state, said controlling step controls a transport amount by the second transport means to be greater than the transport amount by the first transport means, so as to apply tension to the recording medium, and in the first state, said controlling step reduces the transport amount of one of the first and second transport means, and wherein said controlling step controls the transport amounts so as to maintain uniformity of spacing without overlap between a recording section on one part of the recording medium recorded in the second state and a recording section on another part of the recording medium recorded in the first state.

41. A serial recording apparatus comprising:

record means for recording an image on a recording medium according to recording information, said record means forming a recording section of a predetermined width or less in accordance with one scan;

two recording medium transport means provided respectively at upstream and downstream sides of a transport path, for transporting the recording medium, wherein when said two transport means cooperate at the upstream and downstream sides to transport the recording medium, a transport amount of the transport means at the downstream side is set so as to be greater than a transport amount of the transport means at the upstream side to thereby apply tension to the recording medium; and record control means for effecting the recording on the recording medium by changing the recording section in accordance with a difference between the transport amounts for the recording medium of said two transport means, when the recording medium is released from said transport means of the upstream side and is transported by said transport means of the downstream side only, wherein said control means controls the recording section so as to maintain no overlap between a recording section on one part of the recording medium recorded during transportation by said two recording medium transport means and a recording section on another part of the recording medium recorded during transportation by only said recording medium transport means at the downstream side.

42. A serial recording apparatus comprising:

record means for recording an image on a recording medium according to recording information, said record means forming a recording section of a predetermined width or less in accordance with one scan;

two recording medium transport means provided respectively at an upstream side and a downstream side of a transport path, for transporting the recording medium, wherein when said two transport means cooperate at the upstream and downstream sides to transport the recording medium, a transport amount of the transport means at the downstream side is set so as to be greater than a transport amount of the transport means at the upstream side to thereby apply tension to the recording medium; and record control means for effecting the recording on the recording medium by changing the recording section in accordance with a difference between the transport amounts for the recording medium of said two transport means, when the recording medium is not engaged by said transport means of the downstream side and is transported by said transport means of the upstream side only, wherein said control means controls the recording section so as to maintain no overlap between a recording section on one part of the recording medium recorded during transportation by said two recording medium transport means and a recording section on another part of the recording medium recorded during transportation of the transport means at the downstream side is set so as to be greater than a transport amount of the transport means at the upstream side to thereby apply tension to the recording medium; and controlling recording on the recording medium by changing the recording section in accordance with a difference between the transport amounts for the recording medium of the two transport means, when the recording medium is released from the transport means of the upstream side and is transported by the transport means of the downstream side only, wherein said controlling step controls the recording section so as to maintain no overlap between a recording section on one part of the recording medium recorded during transportation by the two recording medium transport means and a recording section on another part of the recording medium recorded during transportation by only the recording medium transport means at the downstream side.

43. A serial recording apparatus comprising:

record means for recording an image on a sheet member;

first and second sheet transport means respectively provided on both sides of said record means; and transport amount control means for controlling amounts of transportation of said first and second sheet transport means in a first state where the sheet member is transported by one of said first and second transport means and in a second state where the sheet member is transported by said first and second sheet transport means in mutual cooperation, wherein in the second state, said transport amount control means controls the amounts of transportation of said first and second sheet transport means to be different from one another so as to apply tension to the sheet member, and in the first state, said transport amount control means controls the amounts of transportation so as to be substantially equal to one another, and wherein said control means controls the transport amounts so as to maintain no overlap between a recording section on one part of the sheet member recorded in the second state and a recording section on another part of the sheet member recorded in the first state.

44. A serial recording apparatus comprising:

record means for recording an image on a sheet member;

first and second sheet transport means respectively provided on both sides of said record means and having mutually different amounts of transportation; and recording area control means for varying a recording area of said record means in a first state where the sheet member is transported by one of said first and second sheet transport means and in a second state where the sheet member is transported by said first and second sheet transport means in mutual cooperation, wherein said recording area control means varies the recording area of said record means between the first state and the second state in accordance with a difference between the amounts of transportation of the sheet member of said first and second sheet transport means, and wherein said control means controls the recording area so as to maintain no overlap between a recording section on one part of the sheet member recorded in the second state and a recording section on another part of the sheet member recorded in the first state.

45. A serial recording apparatus comprising:

record means for recording an image on a sheet member;

first and second sheet transport means respectively provided on both sides of said record means; and control means for controlling the amounts of transportation of said first and second sheet transport means and a recording area of said record means in a first state where the sheet member is transported by one of said first and second sheet transport means and in a second state where the sheet member is transported by said first and second sheet transport means in mutual cooperation, wherein in the second state said control means controls the amounts of transportation of said first and second sheet transport means to be different from one another so as to apply tension to the sheet member, and in the first state said control means controls the amounts of transportation so as to be substantially equal to one another, and said control means also varies the recording area of said record means between the first state and the second state in accordance with a difference between the transport amounts for the sheet member of said first and second sheet transport means, and wherein said control means controls at least one of the recording area and the amounts of transportation so as to maintain no overlap between a recording section on one part of the sheet member recorded in the second state and a recording section on another part of the sheet member recorded in the first state.

46. A serial recording apparatus for forming a record section of a predetermined width or less with record means on a sheet member, said apparatus comprising:

first and second transport means provided respectively at upstream and downstream sides of a transport path, for transporting the sheet member by repeating a step transportation of the sheet member by the predetermined width, wherein when said first and second transport means cooperate at the upstream and downstream sides to transport the sheet member, a transport amount of the second transport means at the downstream side is set so as to be greater than a transport amount of the first transport means at the upstream side to thereby apply tension to the sheet member;

detection means for detecting a rear end of the sheet member;

counter means for counting the number of step transportations for the sheet member until detection of the rear end of the sheet member by said detection means;

determining means for determining the size of the sheet member based on the number of step transportations counted by said counter means; and control means for varying at least one of the transportation amount of the sheet member per print by said transport means at the downstream side and the size of the recording area on said sheet member, after detection of the rear end of the sheet member by said detection means and transportation of the sheet member by only said transport means at the downstream side, in accordance with the determined size of the sheet member, and wherein said control means controls at least one of the recording area and the amounts of transportation so as to maintain no overlap between a recording section on one part of the sheet member recorded during transportation by said first and second transport means and a recording section on another part of the sheet member recorded during transportation by only said transport means at the downstream side.

47. An image recording apparatus for recording images of a predetermined width or less on a recording medium by scanning a recording head, said apparatus comprising:

first transport means for transporting the recording medium for each scan of the recording head, a transport amount by said first transport means corresponding to the predetermined width of the images;

second transport means provided downstream of said first transport means, for transporting the recording medium for each scan of the recording head, when said first and second transport means transport the recording medium in mutual cooperation; and control means for controlling an amount of transportation of said first and second transport means in a first state where the recording medium is transported by one of said first and second transport means and in a second state where the recording medium is transported by said first and second transport means in mutual cooperation, wherein in the second state, said control means controls a transport amount by said second transport means to be greater than the transport amount by said first transport means, so as to apply tension to the recording medium, and in the first state, said control means reduces the transport amount of one of said first and second transport means, and wherein said control means controls the transport amounts so as to maintain no overlap between a recording section on one part of the recording medium recorded in the second state and a recording section on another part of the recording medium recorded in the first state.

48. A serial recording method comprising the steps of:

providing record means for recording an image on a recording medium according to recording information, the record means forming a recording section of a predetermined width or less in accordance with one scan;

providing two recording medium transport means respectively at upstream and downstream sides of a transport path, for transporting the recording medium, wherein when the two transport means cooperate at the upstream and downstream sides to transport the recording medium, a transport amount transport path, for transporting the recording medium, wherein when the two transport means cooperate at the upstream and downstream sides to transport the recording medium, a transport amount of the transport means at the downstream side is set so as to be greater than a transport amount of the transport means at the upstream side to thereby apply tension to the recording medium; and controlling recording on the recording medium by changing the recording section in accordance with a difference between the transport amounts for the recording medium of the two transport means, when the recording medium is not engaged by the transport means of the downstream side and is transported by the transport means of the upstream side only, wherein said controlling step controls the recording section so as to maintain no overlap between a recording section on one part of the recording medium recorded during transportation by the two recording medium transport means and a recording section on another part of the recording medium recorded during transportation by only the recording medium transport means at the upstream side.

49. A serial recording method comprising the steps of:

providing record means for recording an image on a recording medium according to recording information, the record means forming a recording section of a predetermined width or less in accordance with one scan;

providing two recording medium transport means respectively at an upstream side and a downstream side of a by only said recording medium transport means at the upstream side.

50. A serial recording method comprising the steps of:

providing record means for recording an image on a sheet member;

providing first and second sheet transport means respectively on both sides of the record means; and controlling amounts of transportation of the first and second sheet transport means in a first state where the sheet member is transported by one of the first and second transport means and in a second state where the sheet member is transported by the first and second sheet transport means in mutual cooperation, wherein in the second state, said controlling step controls the amounts of transportation of the first and second sheet transport means to be different from one another so as to apply tension to the sheet member, and in the first state, said controlling step controls the amounts of transportation so as to be substantially equal to one another, and wherein said controlling step controls the transport amounts so as to maintain no overlap between a recording section on one part of the sheet member recorded in the second state and a recording section on another part of the sheet member recorded in the first state.

51. A serial recording method comprising the steps of:

providing record means for recording an image on a sheet member;

providing first and second sheet transport means respectively on both sides of the record means and having mutually different amounts of transportation; and controlling by varying a recording area of the record means in a first state where the sheet member is transported by one of the first and second sheet transport means and in a second state where the sheet member is transported by the first and second sheet transport means in mutual cooperation, wherein said controlling step varies the recording area of the record means between the first state and the second state in accordance with a difference between the amounts of transportation of the sheet member of the first and second sheet transport means, and wherein said controlling step controls the recording area so as to maintain no overlap between a recording section on one part of the sheet member recorded in the second state and a recording section on another part of the sheet member recorded in the first state.

52. A serial recording method comprising the steps of:

providing record means for recording an image on a sheet member;

providing first and second sheet transport means respectively on both sides of the record means; and controlling the amounts of transportation of the first and second sheet transport means and a recording area of the record means in a first state where the sheet member is transported by one of the first and second sheet transport means and in a second state where the sheet member is transported by the first and second sheet transport means in mutual cooperation, wherein in the second state said controlling step controls the amounts of transportation of the first and second sheet transport means to be different from one another so as to apply tension to the sheet member, and in the first state said controlling step controls the amounts of transportation so as to be substantially equal to one another, and said controlling step also varies the recording area of the record means between the first state and the second state in accordance with a difference between the transport amounts for the sheet member of the first and second sheet transport means, and wherein said controlling step controls at least one of the recording area and the amounts of transportation so as to maintain no overlap between a recording section on one part of the sheet member recorded in the second state and a recording section on another part of the sheet member recorded in the first state.

53. A serial recording method for forming a record section of a predetermined width or less with record means on a sheet member, said method comprising the steps of:

providing first and second transport means respectively at upstream and downstream sides of a transport path, for transporting the sheet member by repeating a step transportation of the sheet member by the predetermined width, wherein when the first and second transport means cooperate at the upstream and downstream sides to transport the sheet member, a transport amount of the second transport means at the downstream side is set so as to be greater than a transport amount of the first transport means at the upstream side to thereby apply tension to the sheet member;

detecting a rear end of the sheet member;

counting the number of step transportations for the sheet member until detection of the rear end of the sheet member in said detecting step;

determining the size of the sheet member based on the number of step transportations counted in said counting step; and controlling by varying at least one of the transportation amount of the sheet member per print by the transport means at the downstream side and the size of the recording area on the sheet member, after detection of the rear end of the sheet member in said detecting step and transportation of the sheet member by only the transport means at the downstream side, in accordance with the determined size of the sheet member, and wherein said controlling step controls at least one of the recording area and the amounts of transportation so as to maintain no overlap between a recording section on one part of the sheet member recorded during transportation by the first and second transport means and a recording section on another part of the sheet member recorded during transportation by only the transport means at the downstream side.

54. An image recording method for recording images of a predetermined width or less on a recording medium by scanning a recording head, said method comprising the steps of:

providing first transport means for transporting the recording medium for each scan of the recording head, a transport amount by the first transport means corresponding to the predetermined width of the images;

providing second transport means downstream of the first transport means, for transporting the recording medium for each scan of the recording head, when the first and second transport means transport the recording medium in mutual cooperation; and controlling an amount of transportation of the first and second transport means in a first state where the recording medium is transported by one of the first and second transport means and in a second state where the recording medium is transported by the first and second transport means in mutual cooperation, wherein in the second state, said controlling step controls a transport amount by the second transport means to be greater than the transport amount by the first transport means, so as to apply tension to the recording medium, and in the first state, said controlling step reduces the transport amount of one of the first and second transport means, and wherein said controlling step controls the transport amounts so as to maintain no overlap between a recording section on one part of the recording medium recorded in the second state and a recording section on another part of the recording medium recorded in the first state.

* * * * *

UNITED STATES PATENT AND TRADEMARK OFFICE

CERTIFICATE OF CORRECTION

PATENT NO. : 6,095,703
DATED : August 1, 2000
INVENTOR(S) : Tanaka et al.

It is certified that error appears in the above-identified patent and that said Letters Patent is hereby corrected as shown below:

Title page,
Item [56], FOREIGN PATENT DOCUMENTS,
"2249840" should read -- 2-249840 --.

Column 3,
Line 47, "a" should be deleted.

Column 6,
Line 33, "paths" should read -- path --.

Column 16,
Line 53, "embodimetns" should read --embodiments --.

Column 31,
Line 48, "transportation of the transport means at" should read -- transportation by only said recording medium transport means at the upstream side. --.
Lines 49-67 should be deleted.

Column 34,
Lines 11-44 should read as follows:

-- 48. A serial recording method comprising the steps of:
providing record means for recording an image on a recording medium according to recording information, the record means forming a recording section of a predetermined width or less in accordance with one scan;
providing two recording medium transport means respectively at upstream and downstream sides of a transport path, for transporting the recording medium, wherein when the two transport means cooperate at the upstream and downstream sides to transport the recording medium, a transport amount of the transport means at the downstream side is set so as to be greater than a transport amount of the transport means at the upstream side to thereby apply tension to the recording medium; and

UNITED STATES PATENT AND TRADEMARK OFFICE

CERTIFICATE OF CORRECTION

PATENT NO. : 6,095,703
DATED : August 1, 2000
INVENTOR(S) : Tanaka et al.

It is certified that error appears in the above-identified patent and that said Letters Patent is hereby corrected as shown below:

Column 34, (cont.), controlling recording on the recording medium by chnaging the recording section in accordance with a difference between the transport amounts for the recording medium of the two transport means, when the recording medium is released from the transport means of the upstream side and is transported by the transport means of the downstream side only, wherein said controlling step controls the recording section so as to maintain no overlap between a recording section on one part of the recording medium recorded during transportation by the two recording medium transport means and a recording section on another part of the recording medium recorded during transportation by only the recording medium transport means at the downstream side. --.

Lines 45-54 should read as follows:

-- 49. A serial recording method comprising the steps of:

providing record means for recording an image on a recording medium according to recording information, the record means forming a recording section of a predetermined width or less in accordance with one scan;

providing two recording medium transport means respectively at an upstream side and a downstream side of a transport path, for transporting the recording medium, wherein when the two transport means cooperate at the upstream and downstream sides to transport the recording medium, a transport amount of the transport means at the downstream side is set so as to be greater than a transport amount of the transport means at the upstream side to thereby apply tension to the recording medium; and

UNITED STATES PATENT AND TRADEMARK OFFICE

CERTIFICATE OF CORRECTION

PATENT NO. : 6,095,703
DATED : August 1, 2000
INVENTOR(S) : Tanaka et al.

It is certified that error appears in the above-identified patent and that said Letters Patent is hereby corrected as shown below:

Column 34, (cont.), controlling recording on the recording medium by changing the recording section in accordance with a difference between the transport amounts for the recording medium of the two transport means, when the recording medium is not engaged by the transport means of the downstream side and is transported by the transport means of the upstream side only, wherein said controlling step controls the recording section so as to maintain no overlap between a recording section on one part of the recording medium recorded during transportation by the two recording medium transport means and a recording section on another part of the recording medium recorded during transportation by only the recording medium transport means at the upstream side. --.

Signed and Sealed this

Nineteenth Day of February, 2002

*Attest:*

*Attesting Officer*

JAMES E. ROGAN
*Director of the United States Patent and Trademark Office*